US008033881B2

(12) United States Patent
Choi et al.

(10) Patent No.: US 8,033,881 B2
(45) Date of Patent: Oct. 11, 2011

(54) METHOD OF MANUFACTURING FIELD EMISSION DEVICE

(75) Inventors: Jun-Hee Choi, Yongin-si (KR); Min-Jong Bae, Yongin-si (KR)

(73) Assignee: Samsung Electronics Co., Ltd. (KR)

( * ) Notice: Subject to any disclaimer, the term of this patent is extended or adjusted under 35 U.S.C. 154(b) by 524 days.

(21) Appl. No.: 11/812,962

(22) Filed: Jun. 22, 2007

(65) Prior Publication Data

US 2008/0153380 A1 Jun. 26, 2008

(30) Foreign Application Priority Data

Nov. 15, 2006 (KR) ..... 10-2006-0113044

(51) Int. Cl.
*H01J 9/00* (2006.01)
*H01J 9/24* (2006.01)
*H01J 9/04* (2006.01)

(52) U.S. Cl. ..... 445/24; 445/50

(58) Field of Classification Search ..... None
See application file for complete search history.

(56) References Cited

U.S. PATENT DOCUMENTS

| | | | | |
|---|---|---|---|---|
| 5,319,279 | A * | 6/1994 | Watanabe et al. | 313/309 |
| 5,578,896 | A * | 11/1996 | Huang | 313/309 |
| 5,693,235 | A * | 12/1997 | Liu et al. | 216/11 |
| 6,210,246 | B1 * | 4/2001 | Perrin et al. | 445/24 |
| 6,739,931 | B2 * | 5/2004 | Yamazaki et al. | 445/24 |
| 7,180,234 | B2 * | 2/2007 | Oono | 313/497 |
| 2005/0133779 | A1 * | 6/2005 | Choi et al. | 257/10 |
| 2008/0108271 | A1 * | 5/2008 | Kang et al. | 445/51 |

* cited by examiner

*Primary Examiner* — Toan Ton
*Assistant Examiner* — Britt Hanley
(74) *Attorney, Agent, or Firm* — Cantor Colburn LLP

(57) ABSTRACT

A method of manufacturing a field emission device comprises: sequentially forming cathodes and a light blocking layer on a substrate, and patterning the light blocking layer to form blocking layer holes; sequentially forming an insulating layer and a gate material layer on the light blocking layer, and patterning the gate material layer to form gate electrodes in which gate electrode holes are formed; coating a photoresist on the gate electrodes, and exposing and developing the photoresist to form resist holes inside the gate electrode holes; isotropically etching portions of the insulating layer exposed through the resist holes to form insulating layer holes; etching portions of the gate electrodes exposed by the insulating layer holes to form gate holes, and removing the photoresist; and forming emitters on the cathode electrodes exposed by the blocking layer holes.

29 Claims, 16 Drawing Sheets

METHOD OF MANUFACTURING FIELD EMISSION DEVICE

CLAIM OF PRIORITY

This application makes reference to, incorporates the same herein, and claims all benefits accruing under 35 U.S.C. §119 from an application for METHOD OF MANUFACTURING FIELD EMISSION DEVICE earlier filed in the Korean Intellectual Property Office on the Nov. 15, 2006 and there duly assigned Serial No. 10-2006-0113044.

BACKGROUND OF THE INVENTION

1. Technical Field

The present invention relates to a method of manufacturing a field emission device and, more particularly, to a method of manufacturing a stable and reliable field emission device.

2. Related Art

Field emission devices emit electrons from an emitter formed on a cathode by forming a strong electric field around the emitter. Field emission devices are used in a wide range of applications including field emission displays (FEDs) which are flat panel displays. FEDs produce an image by colliding electrons emitted from a field emission device with a phosphor layer formed on an anode. Since FEDs are only a few centimeters thick and feature a wide viewing angle, low power consumption and low manufacturing costs, FEDs together with liquid crystal displays (LCDs) and plasma display panels (PDPs) are attracting attention as the next generation of display devices.

Field emission devices can also be used in backlight units (BLU) of LCDs. LCDs display an image on a front surface by selectively transmitting light emitted by a light source disposed at the rear side of an LCD panel. Examples of the light source which can be disposed at the rear side of an LCD panel include a cold cathode fluorescent lamp (CCFL), an external electrode fluorescent lamp (EEFL), and a light emitting diode (LED). Besides these, a field emission type backlight unit can also be used as the light source. Field emission type backlight units, in principle, have the same driving mechanism for luminance as FEDs. However, field emission type backlight units are different from FEDs in that field emission type backlight units do not display an image but only function as light sources. Field emission type backlight units attract attention as the next generation of backlight units for LCDs because of their thin structure, low manufacturing costs, and brightness control. Field emission devices can also be applied to various systems using electron emission, such as X-ray tubes, microwave amplifiers, and flat lamps.

Micro tips formed of a metal, such as molybdenum (Mo), have been used as emitters of field emission devices. However, recently, carbon nanotubes (CNTs) having good electron emission properties have often been used as emitters. Field emission devices using CNT emitters have the advantages of low cost, a low driving voltage, and high chemical and mechanical stability. CNT emitters may be formed by printing CNT paste or by directly growing CNTs using chemical vapor deposition (CVD). The direct growing of CNTs requires high growth temperature and complex synthesis conditions, thereby making it difficult to achieve mass production. Accordingly, CNT paste has become preferable in recent years.

SUMMARY OF THE INVENTION

The present invention provides a method of manufacturing a stable and reliable field emission device by enabling emitters to be precisely centered in gate holes.

According to an aspect of the present invention, a method of manufacturing a field emission device comprises: sequentially forming cathodes and a light blocking layer on a substrate, and patterning the light blocking layer to form blocking layer holes exposing the cathodes; sequentially forming an insulating layer and a gate material layer on the light blocking layer, and patterning the gate material layer to form gate electrodes in which gate electrode holes exposing portions of the insulating layer over the blocking layer holes are formed; coating a photoresist on the gate electrodes to cover the gate electrode holes, and exposing and developing the photoresist to form resist holes inside the gate electrode holes such that the resist holes correspond in shape to the blocking layer holes and expose portions of the insulating layer; isotropically etching the portions of the insulating layer exposed through the resist holes until the blocking layer holes are exposed to form insulating layer holes; etching portions of the gate electrodes exposed by the insulating layer holes to form gate holes, and removing the photoresist; and forming emitters on the cathode electrodes exposed by the blocking layer holes.

The gate electrode holes may be greater than the blocking layer holes and less than the gate holes.

The resist holes may be formed by exposing and developing the photoresist through backside exposure using the light blocking layer as a photomask. The photoresist may be a positive photoresist. The resist holes may be concentric with the blocking layer holes.

The substrate may be a transparent substrate. The light blocking layer may be formed of amorphous silicon.

The cathodes may be formed of a transparent conductive material. The cathodes may be formed of indium tin oxide (ITO). The insulating layer may be formed of a transparent material.

The gate material layer may be formed of a material having etch selectivity with respect to the cathodes. The gate material layer may be formed of a metal selected from the group consisting of Cr, Ag, Al, Mo, Nb, and Au.

The gate holes may be formed by wet etching the portions of the gate electrodes exposed by the insulating layer holes. The insulating layer may be wet etched. The forming of the emitters may comprise: coating carbon nanotube (CNT) paste so as to fill the blocking layer holes, the insulating layer holes, and the gate holes; and exposing and developing the CNT paste through backside exposure using the light blocking layer as a photomask, and forming emitters formed of CNTs on the cathodes exposed by the blocking layer holes.

According to another aspect of the present invention, a method of manufacturing a field emission device comprises: sequentially forming cathodes and a light blocking layer on a substrate, and patterning the light blocking layer to form blocking layer holes exposing the cathodes; sequentially forming an insulating layer and a gate material layer on the light blocking layer; coating a photoresist on the gate material layer, and exposing and developing the photoresist to form resist holes which correspond in shape to the blocking layer holes, and to expose portions of the gate material layer disposed over the blocking layer holes; etching the portions of the gate material layer exposed by the resist holes to form gate electrodes in which gate electrode holes exposing portions of the insulating layer are formed; isotropically etching the portions of the insulating layer exposed through the gate electrode holes until the blocking layer holes are exposed to form insulating layer holes; etching portions of the gate electrodes exposed by the insulating layer holes to form gate holes, and etching the cathodes exposed by the blocking layer holes to form cathode holes; removing the photoresist; and forming emitters on portions of the substrate exposed through the cathode holes.

According to another aspect of the present invention, a method of manufacturing a field emission device comprises: sequentially forming cathodes and a light blocking layer on a substrate, and patterning the light blocking layer to form blocking layer holes exposing the cathodes; sequentially forming an insulating layer and a gate material layer on the light blocking layer, and patterning the gate material layer to form gate electrodes in which gate electrode holes exposing portions of the insulating layer and disposed over the blocking layer holes are formed; forming a conductive transparent material layer on the gate electrodes and the portions of the insulating layer exposed by the gate electrode holes; coating a photoresist on the transparent material layer, and exposing and developing the photoresist to form resist holes which correspond in shape to the blocking layer holes and which expose portions of the transparent material layer disposed over the blocking layer holes; etching the portions of the transparent material layer exposed by the resist holes to form transparent electrodes in which transparent electrode holes exposing portions of the insulating layer are formed; isotropically etching the portions of the insulating layer exposed through the transparent electrode holes until the blocking layer holes are exposed to form insulating layer holes; etching the transparent electrodes exposed by the insulating layer holes to form gate holes, and removing the photoresist; and forming emitters on the cathodes exposed by the blocking layer holes.

According to another aspect of the present invention, a method of manufacturing a field emission device comprises: sequentially forming cathodes and a light blocking layer on a substrate, and patterning the light blocking layer to form blocking layer holes exposing the cathodes; sequentially forming an insulating layer, a conductive transparent material layer and a gate material layer on the light blocking layer, and patterning the gate material layer to form gate electrodes in which gate electrode holes exposing portions of the transparent material layer and disposed over the blocking layer holes are formed; coating a photoresist to cover the gate electrodes and the portions of the transparent material layer, and exposing and developing the photoresist to form resist holes which correspond in shape to the blocking layer holes and which expose portions of the transparent material layer disposed over the blocking layer holes; etching the portions of the transparent material layer exposed by the resist holes to form transparent electrodes in which transparent electrode holes exposing portions of the insulating layer are formed; isotropically etching the portions of the insulating layer exposed through the transparent electrode holes until the blocking layer holes are exposed to form insulating layer holes; etching portions of the transparent electrodes exposed by the insulating layer holes to form gate holes, and removing the photoresist; and forming emitters on the cathodes exposed by the blocking layer holes.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
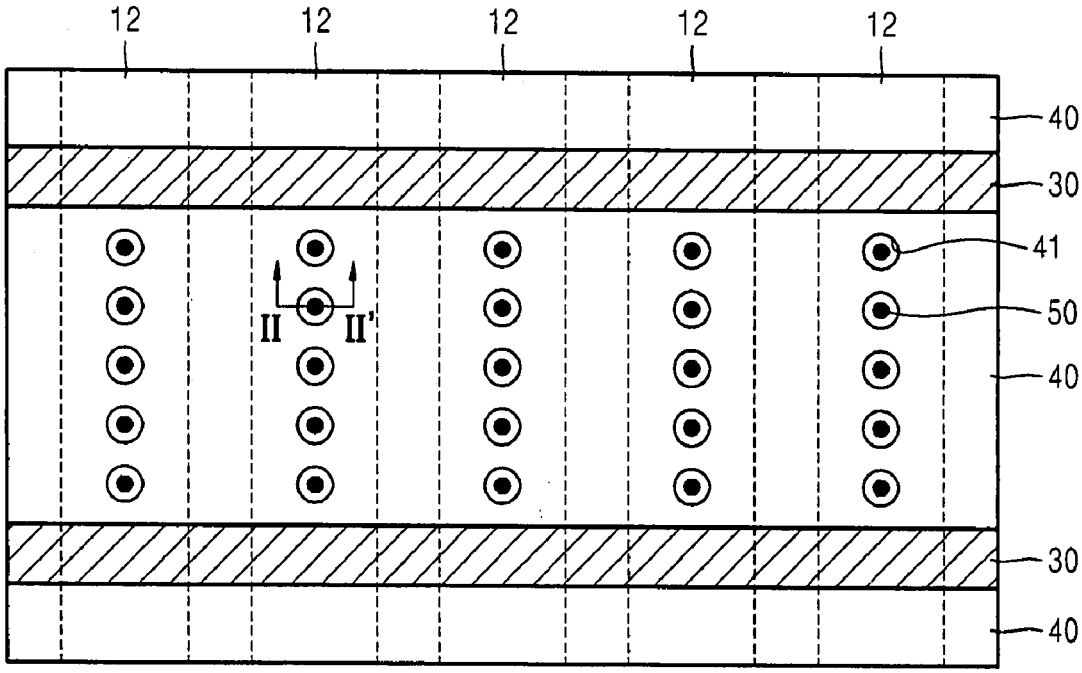
FIG. 1 is a plan view of a field emission device.

The present invention will now be described more fully with reference to the accompanying drawings, in which exemplary embodiments of the invention are shown. Like reference numerals denote like elements throughout. In the drawings, the sizes of components may be exaggerated for clarity. It will also be understood that, when a layer is referred to as being "on" a substrate or another layer, it can be directly on the substrate or the other layer, or intervening layers may also be present therebetween.

Figure 2:
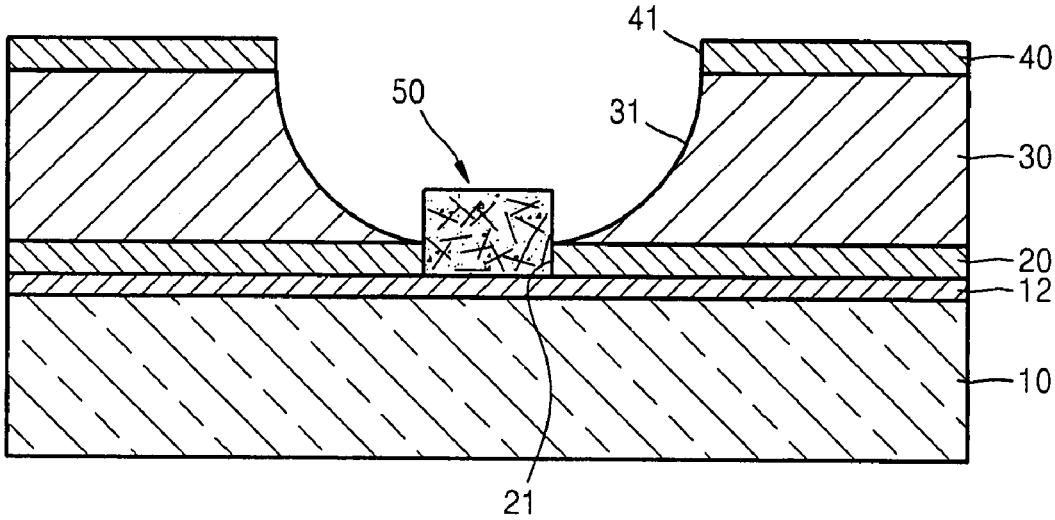
FIG. 2 is a cross-sectional view taken along line II-II' of FIG. 1.

FIG. 1 is a plan view of a field emission device, and FIG. 2 is a cross-sectional view taken along line II-II' of FIG. 1.

Referring to FIGS. 1 and 2, the field emission device is configured such that a plurality of cathodes 12, an ultraviolet (UV) blocking layer 20, an insulating layer 30, and a plurality of gate electrodes 40 are sequentially stacked on a substrate 10. The cathodes 12 and the gate electrodes 40 intersect each other. Insulating layer holes 31 are formed in the insulating layer 30 so as to expose the cathodes 12, and gate holes 41 are formed in the gate electrodes 40 so as to communicate with the insulating layer holes 31. Blocking layer holes 21 are formed in the UV blocking layer 20 so as to communicate with the insulating layer holes 31 and expose the cathodes 12. Emitters 50 for electron emission are disposed on the cathodes 12 in the blocking layer holes 21. The emitters 50 may be formed by patterning nanotube (CNT) paste through backside exposure using the UV blocking layer 20 as a photomask. In the field emission device constructed as described above, when a strong electric field is applied between the gate electrodes 40 and the emitters 50 formed on the cathodes 12, electrons are emitted from the emitters 50.

Unless the emitters 50 are precisely aligned in the centers of the gate holes 41 of the conventional field emission device constructed as described above, electron emission uniformity is degraded. Accordingly, in order to realize a stable and reliable field emission device, it is necessary for the gate holes 41 to be precisely concentric with the blocking layer holes 21 in which the emitters 50 are disposed.

FIGS. 3 thru 10 are cross-sectional views illustrating a method of manufacturing a field emission device according to an embodiment of the present invention.

Figure 3:
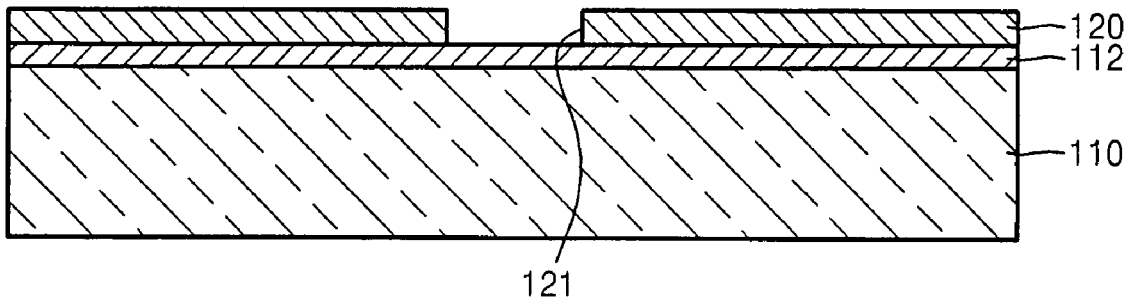
FIGS. 3 thru 10 are cross-sectional views illustrating a method of manufacturing a field emission device according to an embodiment of the present invention.

Referring to FIG. 3, cathodes 112 are formed on a substrate 110. The substrate 110 may be a transparent substrate. Accordingly, the substrate 110 may be a glass or plastic substrate. The cathodes 112 may be formed by depositing a cathode material layer on the substrate 110 and patterning the cathode material layer into predetermined shapes. The cathodes 112 may be formed of a transparent conductive material, for example, indium tin oxide (ITO). A light blocking layer 120 is formed on the substrate 110 so as to cover the cathodes 112, and is then patterned so as to form blocking layer holes 121 exposing the cathodes 112. Emitters 150 (see FIG. 10) formed of carbon nanotubes (CNTs) are formed in the blocking layer holes 121 in a subsequent process. The light blocking layer 120, which is to be used as a photomask in a subsequent backside exposure process, may be formed of a material which can block ultraviolet (UV) rays. For example, the light blocking layer 120 may be formed of amorphous silicon.

Figure 4:
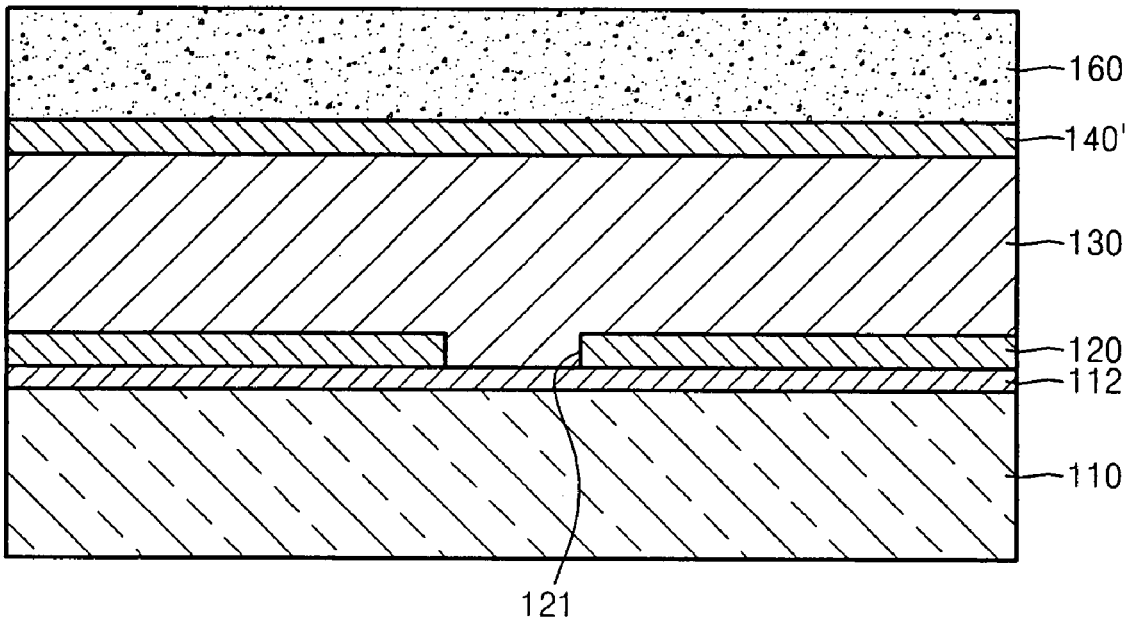

Referring to FIG. 4, an insulating layer 130 and a gate material layer 140' are sequentially formed on the light blocking layer 120. The insulating layer 130 may be formed by depositing a transparent dielectric material, such as silicon oxide, on the light blocking layer 120. The gate material layer 140' may be formed of a material having etch selectivity with respect to the cathodes 112. For example, the gate material layer 140' may be formed of a metal such as Cr, Ag, Al, Mo, Nb, or Au.

Figure 5:
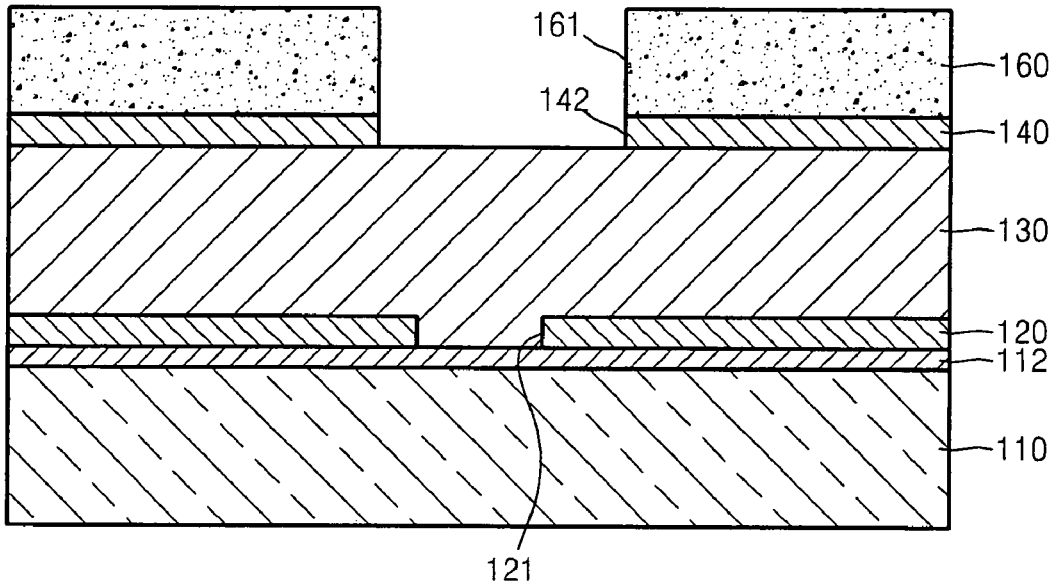

Referring to FIG. 4 and FIG. 5, the gate material layer 140' is patterned to form gate electrodes 140 in which gate electrode holes 142 are formed. In detail, a first photoresist 160 is coated on the gate material layer 140'. The first photoresist 160 may be a positive or negative photoresist. Next, the first photoresist 160 is exposed and developed to form first resist holes 161 exposing the gate material layer 140'. The gate material layer 140' is etched through the first resist holes 161 to form gate electrodes 140 in which the gate electrode holes 142 exposing the insulating layer 130 are formed. The gate electrode holes 142 are formed over the blocking layer holes 121, and may be wider than the blocking layer holes 121 and narrower than gate holes 141 (FIG. 9) which will be explained later. The gate electrode holes 142 (FIG. 5) formed in this process do not have to be concentric with the blocking layer holes 121. Next, the first photoresist 160 is removed from the gate electrodes 140.

Figure 6:
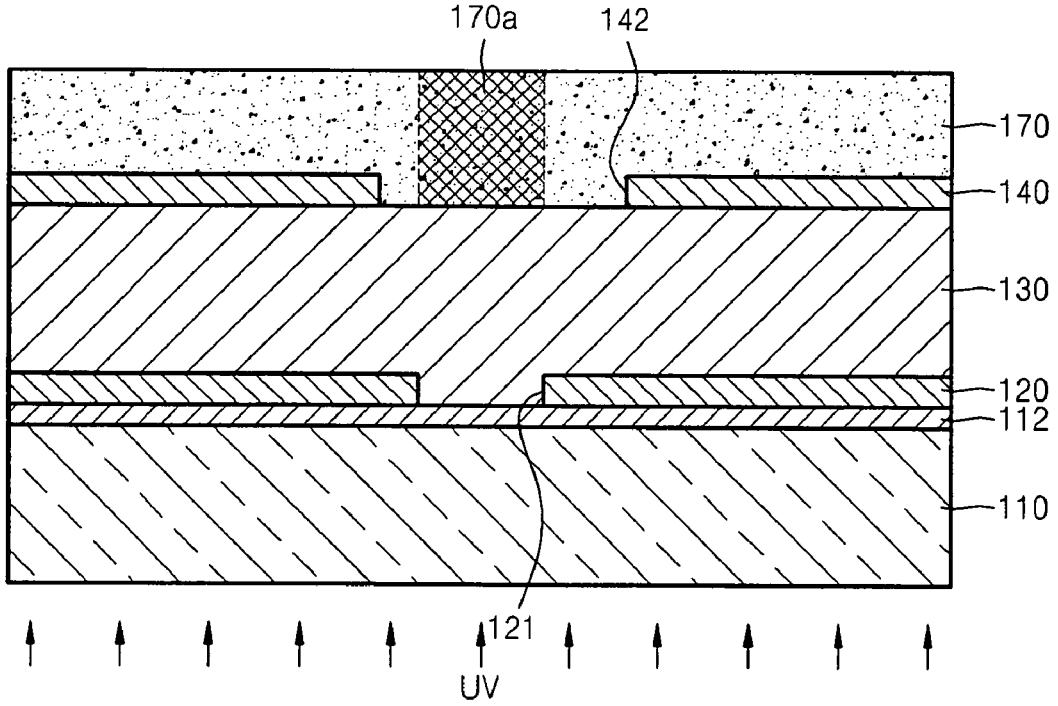

Referring to FIG. 6, a second photoresist 170 is coated on the gate electrodes 140 so as to cover the gate electrode holes 142. The second photoresist 170 may be a positive photoresist. Next, the second photoresist 170 is exposed using backside exposure. In detail, UV rays are emitted from below the substrate 110 using the light blocking layer 120 as a photomask so as to expose portions 170*a* of the second photoresist 170 disposed over the blocking layer holes 121.

Figure 7:
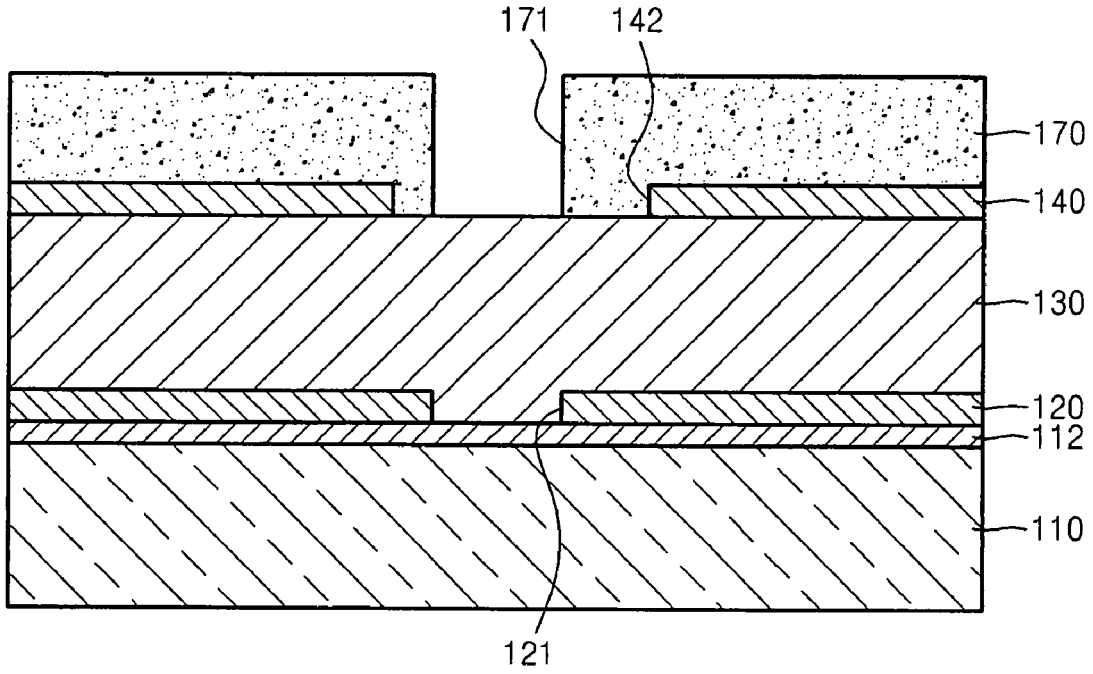

Referring to FIG. 6 and FIG. 7, when the exposed portions 170*a* of the second photoresist 170 are developed and removed, second resist holes 171 exposing the insulating layer 130 are formed inside the gate electrode holes 142. Accordingly, the second resist holes 171 are concentric with the blocking layer holes 121, and correspond in diameter and shape to the blocking layer holes 121.

Figure 8:
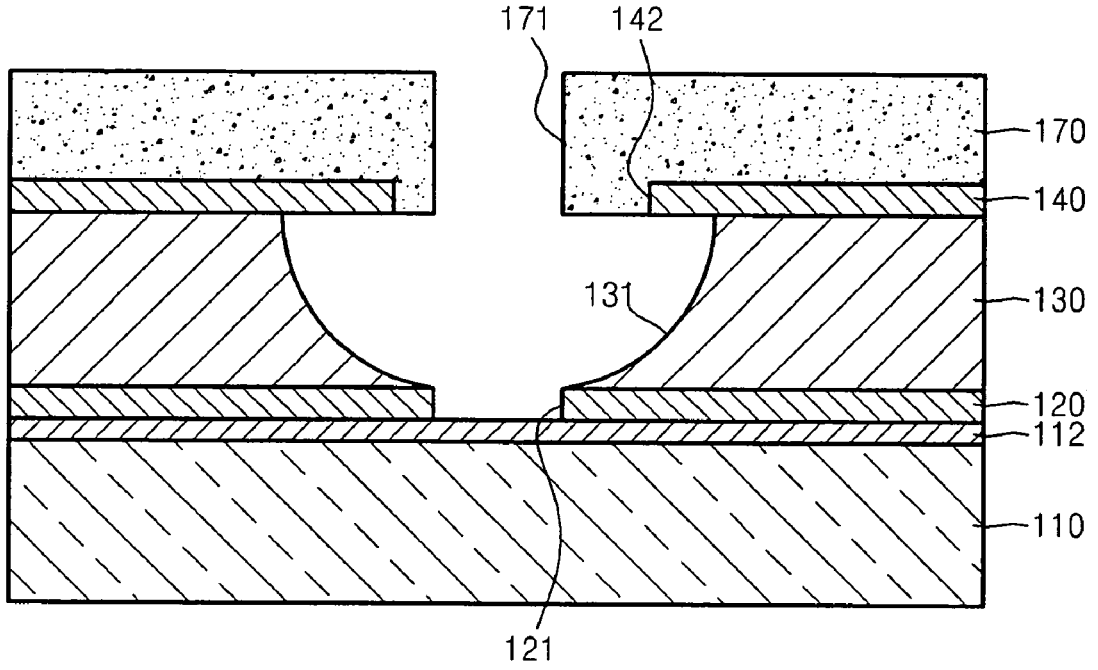

Referring to FIG. 8, the insulating layer 130 exposed by the second resist holes 171 is etched to form insulating layer holes 131. The insulating layer holes 131 may be formed by isotropically wet etching the insulating layer 130 until the blocking layer holes 121 are exposed. Due to the isotropic wet etching of the insulating layer 130, each of the insulating layer holes 131 may have a substantially hemispheric shape. Accordingly, the cathodes 112 under the insulating layer holes 131 are exposed through the blocking layer holes 121, and the gate electrodes 140 and the second photoresist 170 over the insulating layer holes 131 are partially exposed through the insulating layer holes 131.

Figure 9:
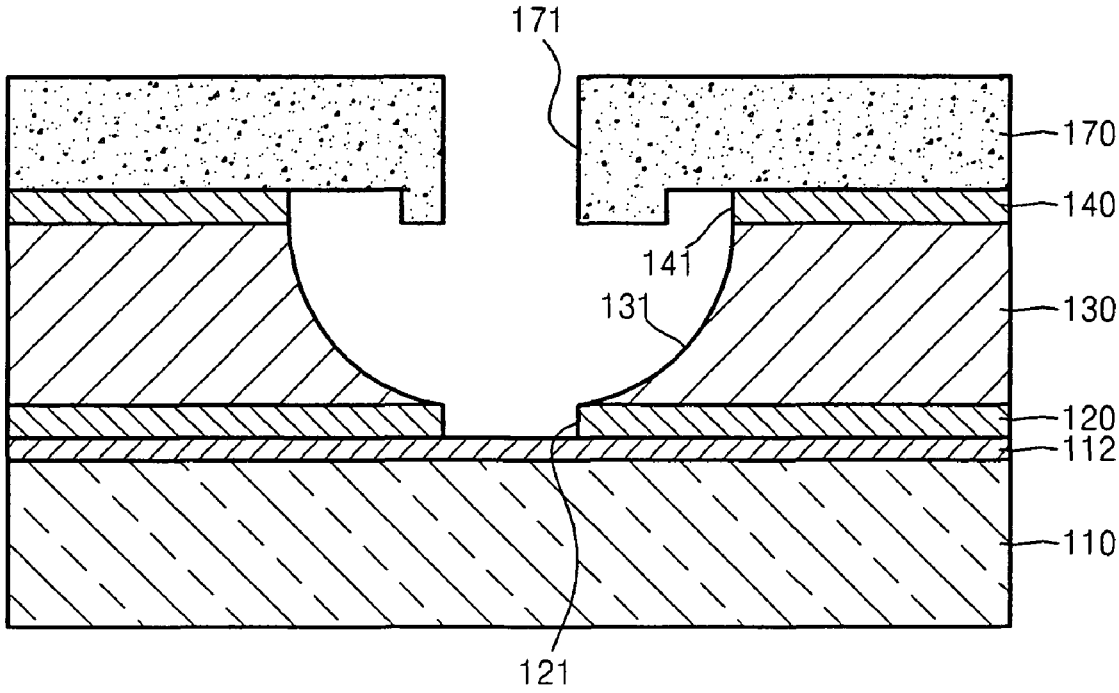

Referring to FIG. 9, portions of the gate electrodes 140 exposed by the insulating layer holes 131 are etched to form the gate holes 141. The gate holes 141 may be formed by wet etching the portions of the gate electrodes 140 exposed by the insulating layer holes 131. Since the cathodes 112 are formed of a material having etch selectivity with respect to the gate electrodes 140, the cathodes 112 exposed through the blocking layer holes 121 are not removed during the etching of the gate electrodes 140. Next, the second photoresist 170 is removed from the gate electrodes 140.

Figure 10:
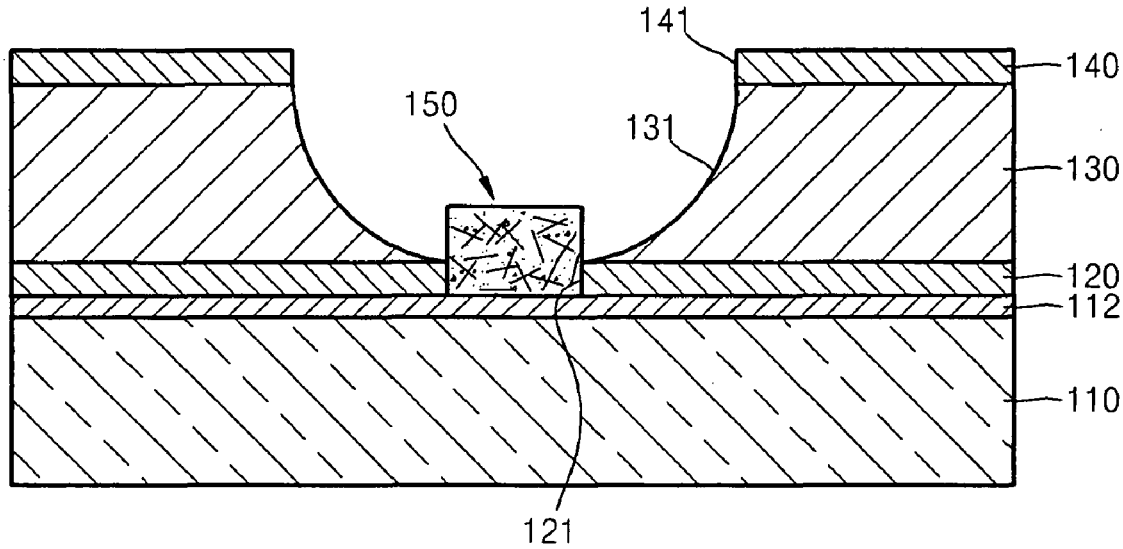

Referring to FIG. 10, emitters 150 are formed on the cathodes 112 exposed through the blocking layer holes 121. In detail, CNT paste is prepared by dispersing CNTs in a solvent containing a mixture of a binder and a photosensitizer. The photosensitizer is a negative photosensitizer. Next, the CNT paste is coated on the gate electrodes 140 so as to fill the blocking layer holes 121, the insulating layer holes 131 and the gate holes 141. Next, when the CNT paste is exposed and developed by backside exposure using the light blocking layer 120 as a photomask, the emitters 150 formed of CNTs are formed on the cathodes 112 in the blocking layer holes 121.

Since the insulating layer holes 131 are formed by isotropically etching the insulating layer 130 through the second resist holes 171 which are concentric with the blocking layer holes 121, and the portions of the gate electrodes 140 exposed by the insulating layer holes 131 are etched and removed, the gate holes 141 are precisely concentric with the blocking layer holes 121. Accordingly, the emitters 150 formed in the blocking layer holes 121 can be precisely centered in the gate holes 141.

A method of manufacturing a field emission device according to another embodiment of the present invention will now be explained.

FIGS. 11 thru 16 are cross-sectional views illustrating a method of manufacturing a field emission device according to another embodiment of the present invention. The following explanation will be made focusing on the difference between the method of FIGS. 3 thru 10 and the method of FIGS. 11 thru 16.

Figure 11:
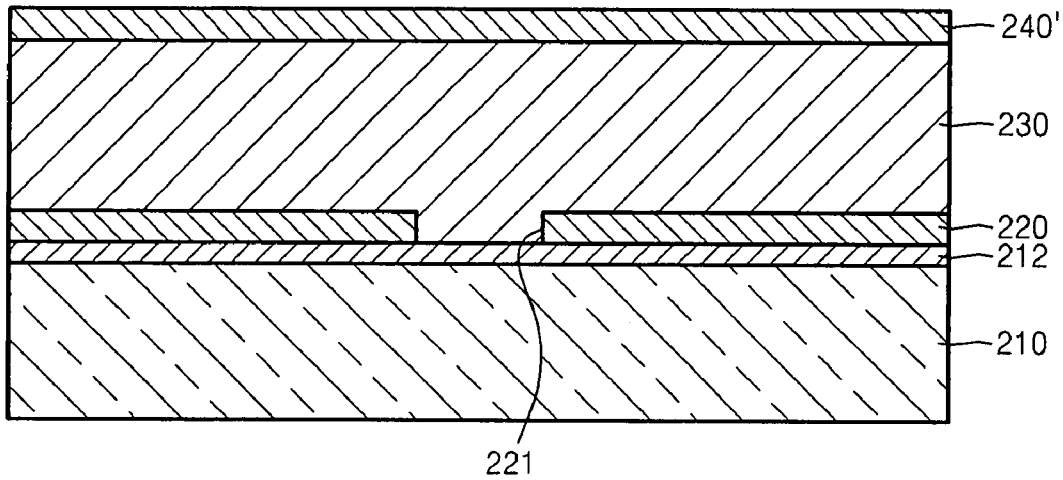
FIGS. 11 thru 16 are cross-sectional views illustrating a method of manufacturing a field emission device according to another embodiment of the present invention.

Referring to FIG. 11, cathodes 212 are formed on a substrate 210. The substrate 210 may be a transparent substrate. The cathodes 212 may be formed of a transparent conductive material such as ITO. Next, a light blocking layer 220 is formed on the substrate 210 so as to cover the cathodes 212, and is then patterned to form blocking layer holes 221 exposing the cathodes 212. The light blocking layer 220 may be formed of amorphous silicon. Next, an insulating layer 230 and a gate material layer 240' are sequentially formed on the light blocking layer 220. The insulating layer 230 may be formed by depositing a transparent dielectric material, such as silicon oxide, on the light blocking layer 220. The gate material layer 240' may be formed of a transparent conductive material, such as ITO, like the cathodes 212.

Figure 12:
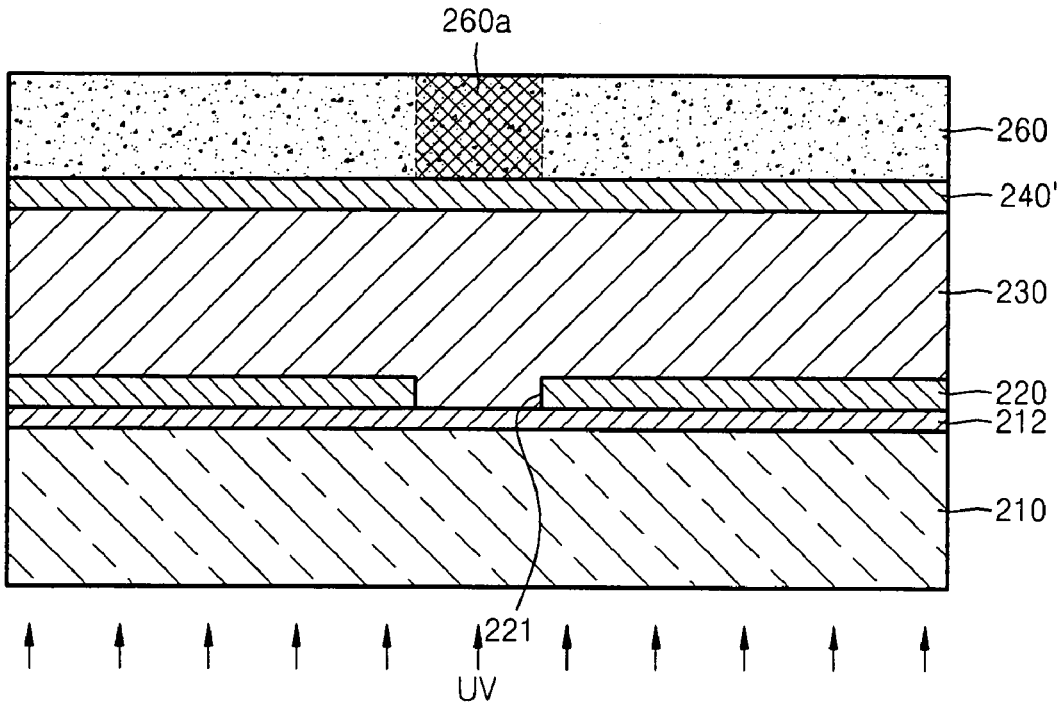

Referring to FIG. 12, a photoresist 260 is coated on the gate material layer 240'. The photoresist 260 may be a positive photoresist. Next, the photoresist 260 is exposed by backside exposure. In detail, UV rays are emitted from below the substrate 210 using the light blocking layer 220 as a photomask so as to expose portions 260*a* of the photoresist 260 disposed over the blocking layer holes 221.

Figure 13:
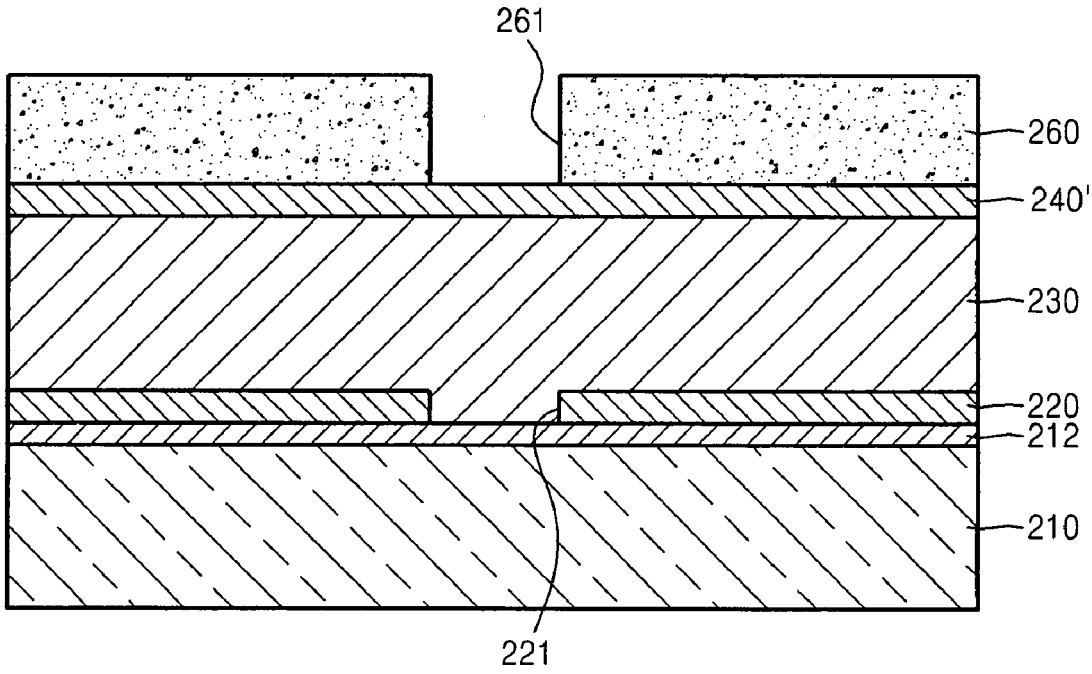

Referring to FIG. 12 and FIG. 13, when the exposed portions 260*a* of the photoresist 260 are developed and removed, resist holes 261 exposing the gate material layer 240' are formed. Accordingly, the resist holes 261 are concentric with the blocking layer holes 221, and correspond in diameter and shape to the blocking layer holes 221.

Figure 14:
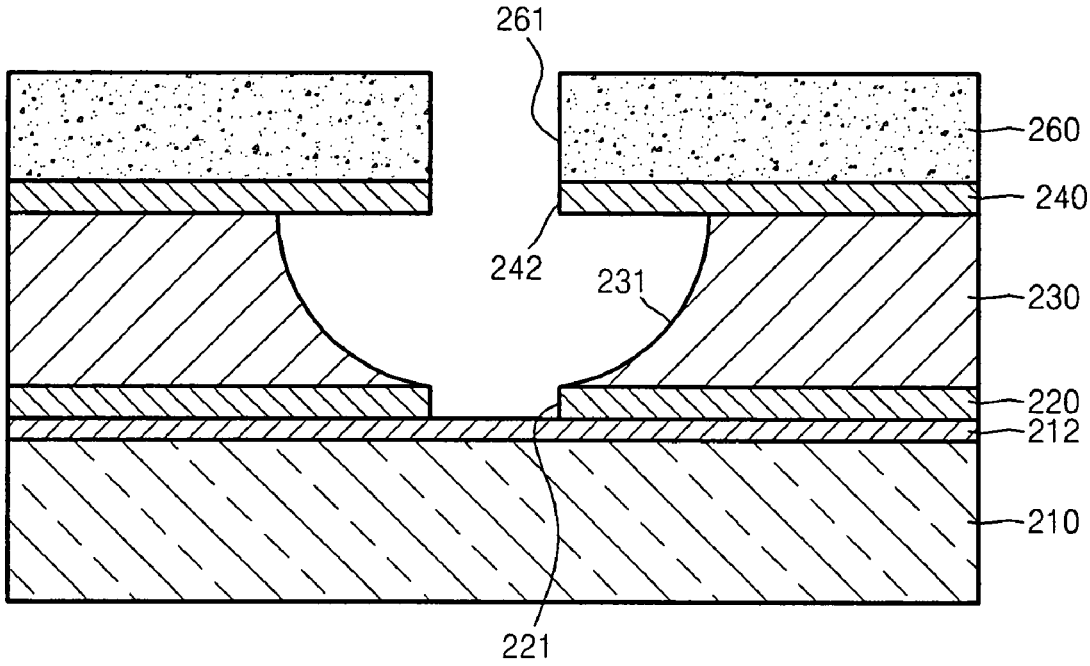

Referring to FIG. 13 and FIG. 14, the gate material layer 240' exposed through the resist holes 261 is etched to form gate electrodes 240 in which gate electrode holes 242 exposing the insulating layer 230 are formed. Like the resist holes 261, the gate electrode holes 242 are concentric with the blocking layer holes 221, and correspond in diameter and shape to the blocking layer holes 221. Next, portions of the insulating layer 230 exposed through the gate electrode holes 242 are etched to form insulating layer holes 231. The insulating layer holes 231 may be formed by isotropically wet etching the insulating layer 230 until the blocking layer holes 221 are exposed. Due to the isotropic etching of the insulating layer 230, each of the insulating layer holes 231 may have a substantially hemispheric shape. Accordingly, the cathodes 212 under the insulating layer holes 231 are exposed through the blocking layer holes 221, and the gate electrodes 240 over the insulating layer holes 231 are partially exposed by the insulating layer holes 231.

Figure 15:
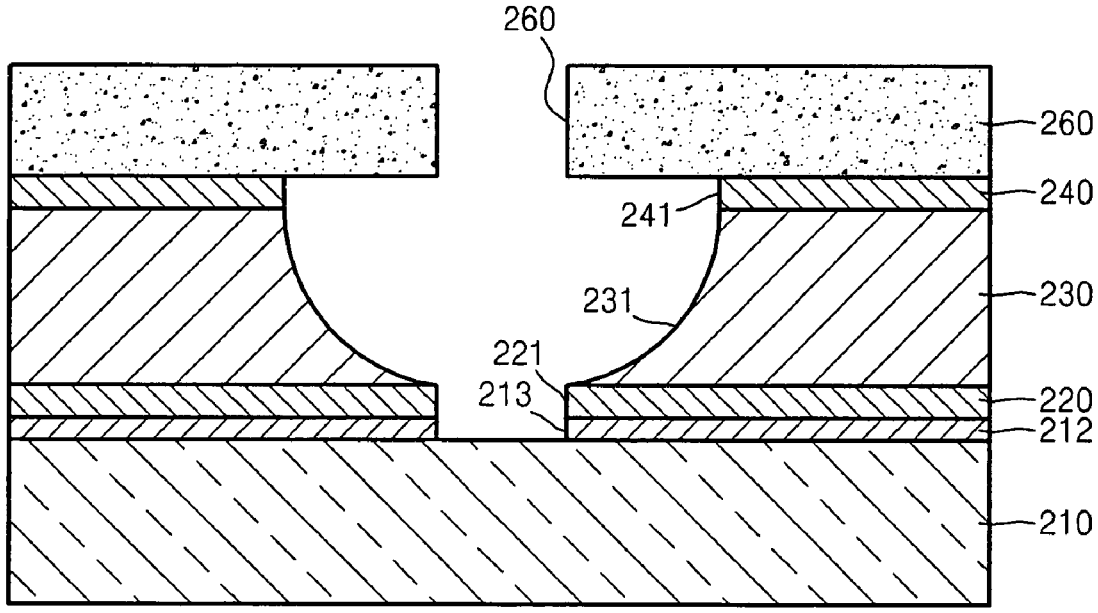

Referring to FIG. 15, portions of the gate electrodes 240 exposed by the insulating layer holes 231 are etched to form gate holes 241, and portions of the cathodes 212 exposed through the blocking layer holes 221 are etched to form cathode holes 213. The gate holes 241 and the cathode holes 213 may be formed by wet etching the gate electrodes 240 and the cathodes 212, respectively. Since the gate electrodes 240 and the cathodes 212 are formed of a transparent conductive material, such as ITO, the gate electrodes 240 and the cathodes 212 can be etched simultaneously. Next, the photoresist 260 is removed from the gate electrodes 240.

Figure 16:
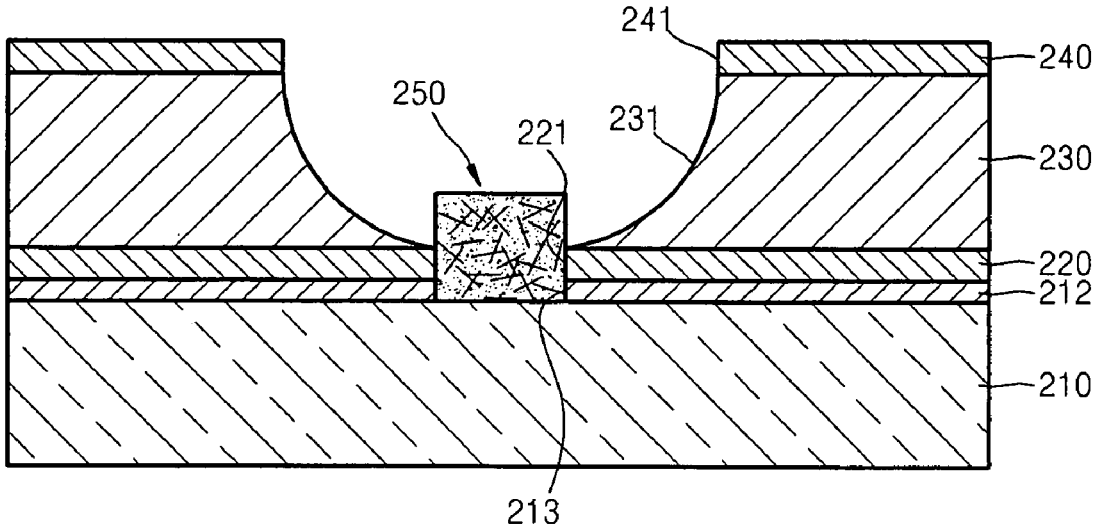

Referring to FIG. 16, emitters 250 are formed on portions of the substrate 210 exposed through the blocking layer holes 221 and the cathode holes 213. In detail, CNT paste is coated on the gate electrodes 240 to fill the cathode holes 213, the blocking layer holes 221, the insulating layer holes 231, and the gate holes 241. Next, when the CNT paste is exposed and developed by backside exposure using the light blocking layer 220 as a photomask, the emitters 250 formed of CNTs are formed on the substrate 210 in the blocking layer holes 221 and the cathode holes 213.

As described above, since the insulating layer holes 231 are formed by isotropically etching the insulating layer 230 through the gate electrode holes 242 which are concentric with the blocking layer holes 221, and the portions of the gate electrodes 240 exposed by the insulating layer holes 231 are etched and removed, the gate holes 241 are precisely concentric with the blocking layer holes 221. Accordingly, the emitters 250 formed in the blocking layer holes 221 and the cathode holes 213 can be precisely centered in the gate holes 241.

A method of manufacturing a field emission device according to another embodiment of the present invention will now be explained.

FIGS. 17 thru 23 are cross-sectional views illustrating a method of manufacturing a field emission device according to another embodiment of the present invention. The following explanation will be made focusing on the difference between the methods of FIGS. 3 through 16 and the method of FIGS. 17 thru 23.

Figure 17:
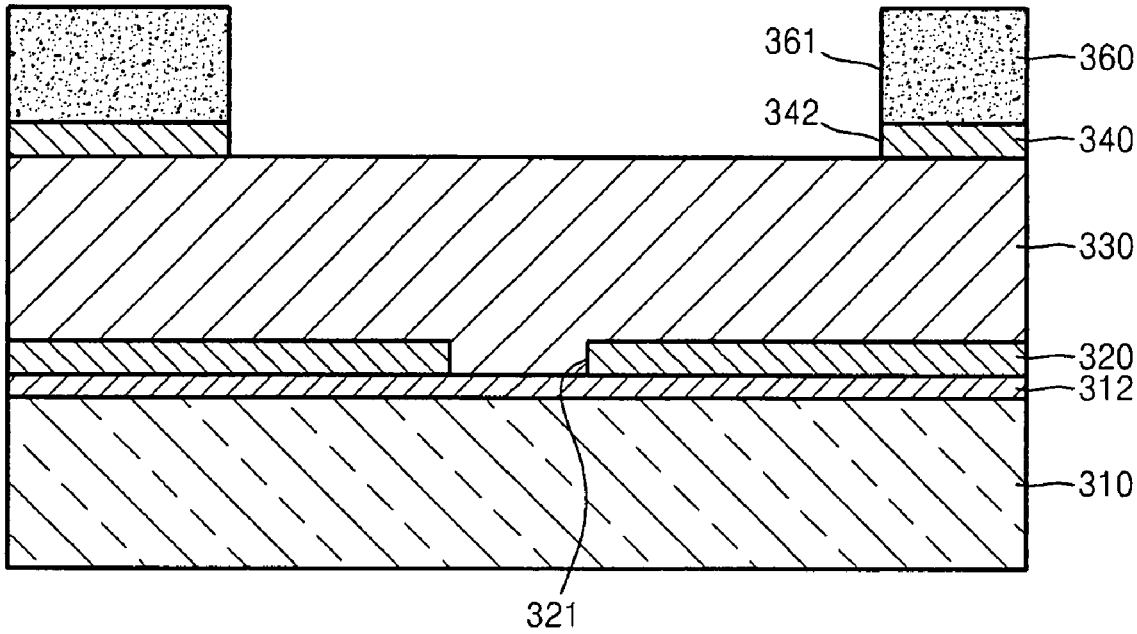
FIGS. 17 thru 23 are cross-sectional views illustrating a method of manufacturing a field emission device according to another embodiment of the present invention.

Referring to FIG. 17, cathodes 312 are formed on a substrate 310. The substrate 310 may be a transparent substrate. The cathodes 312 may be formed of a transparent conductive material such as ITO. A light blocking layer 320 is formed on the substrate 310 so as to cover the cathodes 312, and is then patterned to form blocking layer holes 321 exposing the cathodes 312. The light blocking layer 320 may be formed of amorphous silicon. Next, an insulating layer 330 formed of a transparent dielectric material, such as silicon oxide, is formed on the light blocking layer 320. Next, a gate material layer (not shown) is formed on the insulating layer 330. The gate material layer may be formed of a transparent conductive material, such as ITO, or a metal, such as Cr, Ag, Al, Mo, Nb, or Au.

Next, the gate material layer is patterned to form gate electrodes 340 in which gate electrode holes 342 exposing the insulating layer 330 are formed. In detail, a first photoresist 360 is coated on the gate material layer. The first photoresist 360 may be a positive or negative photoresist. Next, the first photoresist 360 is exposed and developed to form first resist holes 361 exposing the gate material layer. The gate material layer is etched through the first resist holes 361 to form gate electrodes 340 in which gate electrode holes 342 exposing the insulating layer 330 are formed. The gate electrode holes 342 are formed over the blocking layer holes 321, and may be wider than gate holes 341 (FIG. 22) which will be explained later. The gate electrode holes 342 (FIG. 17) formed in this process do not have to be precisely concentric with the blocking layer holes 321. Next, the first photoresist 360 is removed from the gate electrodes 340.

Figure 18:
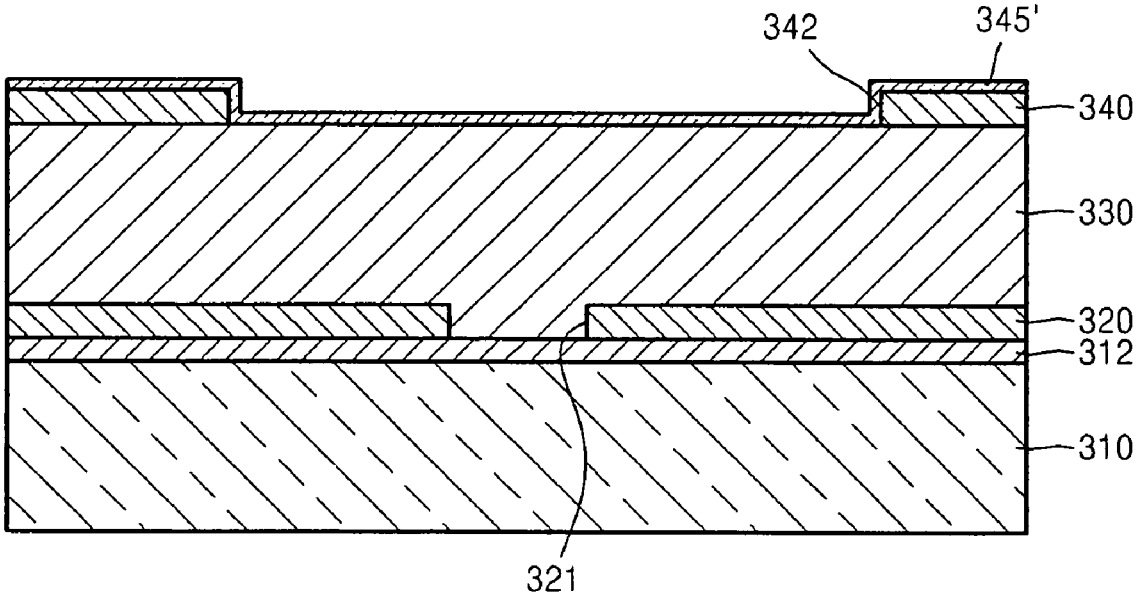

Referring to FIG. 18, a conductive transparent material layer 345' is formed on top surfaces of the gate electrodes 340, and on portions of a top surface of the insulating layer 330 exposed through the gate electrode holes 342. The transparent material layer 345' may be a metallic film having etch selectivity with respect to the cathodes 312. In this case, the metallic film may have a thickness of approximately 100 to 500 Å. For example, the transparent material layer 345' may be formed of a metal such as Cr, Ag, Al, Mo, Nb, or Au.

Figure 19:
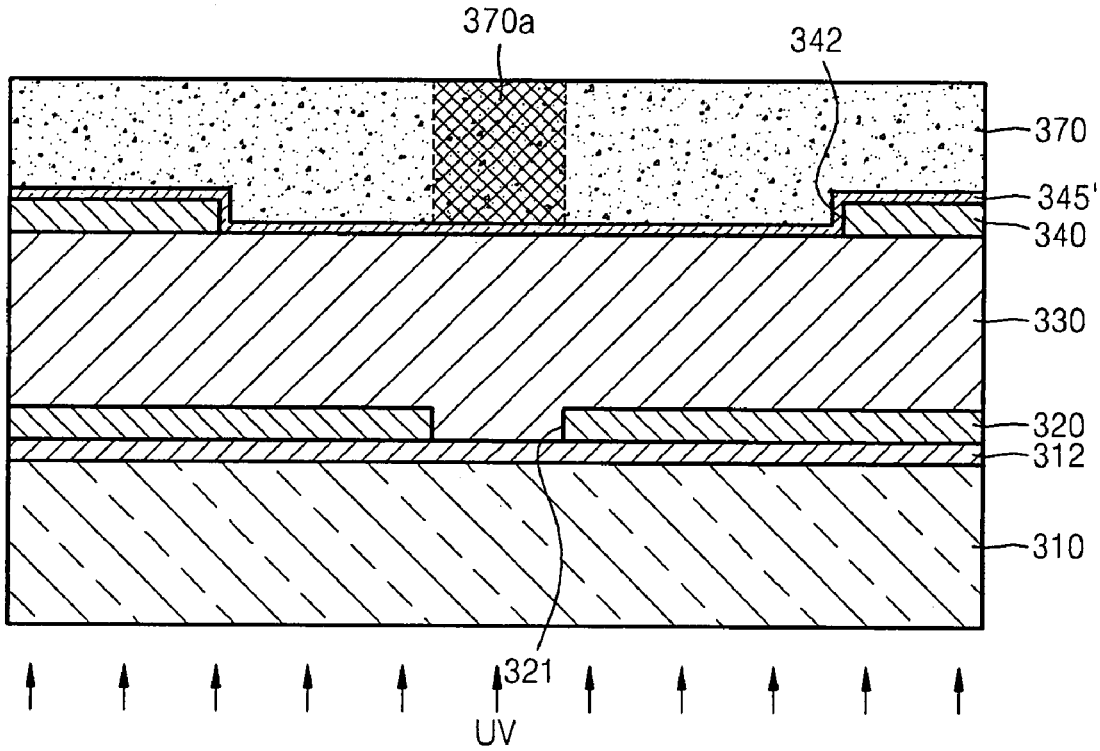

Referring to FIG. 19, a second photoresist 370 is coated on the transparent material layer 345'. The second photoresist 370 may be a positive photoresist. Next, the second photoresist 370 is exposed by backside exposure. In detail, UV rays are emitted from below the substrate 310 using the light blocking layer 320 as a photomask so as to expose portions **370*a* of the second photoresist 370 disposed over the blocking layer holes 321**.

Figure 20:
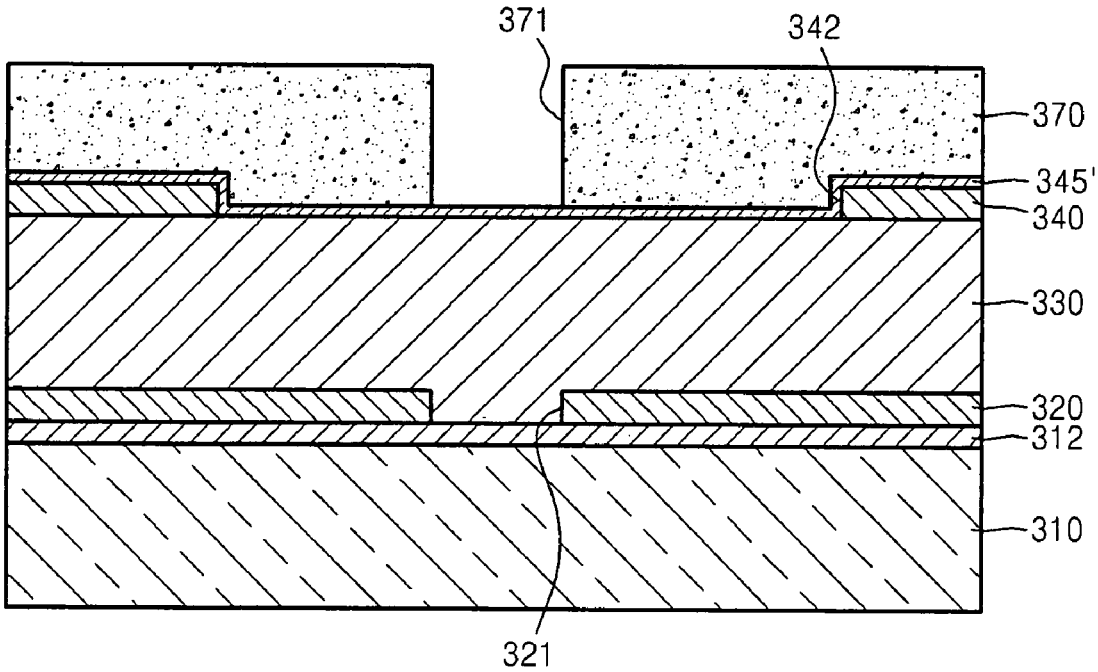

Referring to FIG. 19 and FIG. 20, when the exposed portions **370*a* of the second photoresist 370 are developed and removed, second resist holes 371 exposing the transparent material layer 345' are formed inside the gate electrode holes 342. Accordingly, the second resist holes 371 are concentric with the blocking layer holes 321, and correspond in diameter and shape to the blocking layer holes 321**.

Figure 21:
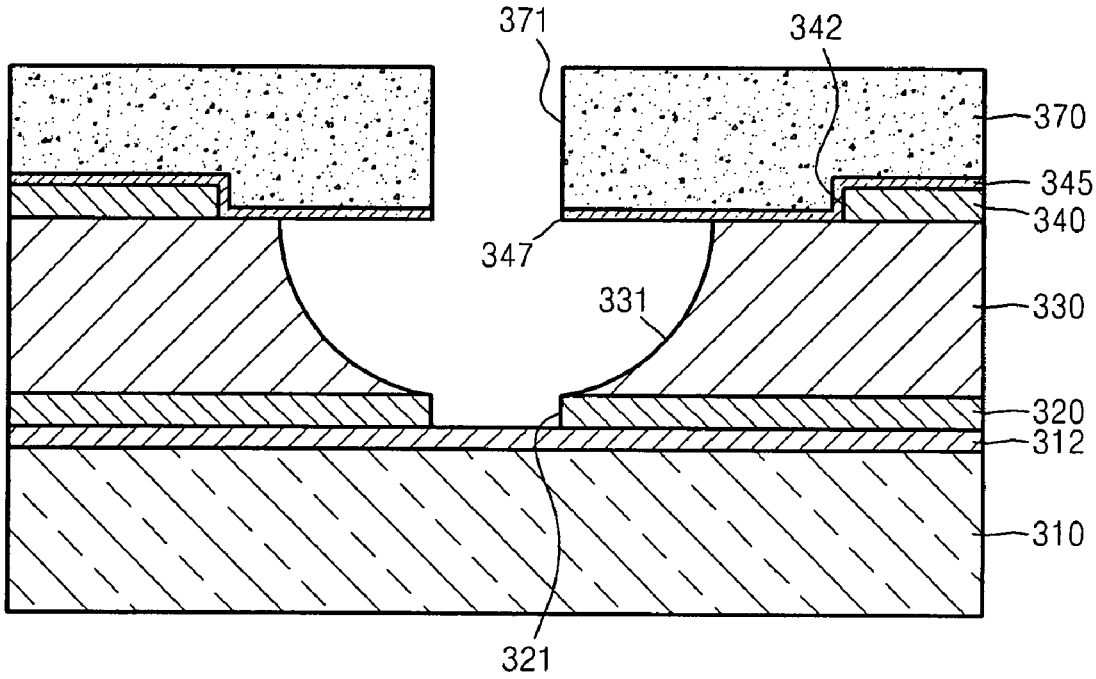

Referring to FIG. 20 and FIG. 21, the transparent material layer 345' exposed through the second resist holes 371 is etched to form transparent electrodes 345 in which transparent electrode holes 347 exposing the insulating layer 330 are formed. The transparent electrodes 345 formed of a metallic film act as bus electrodes of the gate electrodes 340. Like the second resist holes 371, the transparent electrode holes 347 are concentric with the blocking layer holes 321, and correspond in diameter and shape to the blocking layer holes 321. Next, portions of the insulating layer 330 exposed through the transparent electrode holes 347 are etched to form insulating layer holes 331. The insulating layer holes 330 may be formed by isotropically wet etching the insulating layer 330 until the blocking layer holes 321 are exposed. Due to the isotropic etching of the insulating layer 330, each of the insulating layer holes 331 may have a substantially hemispheric shape. Accordingly, the cathodes 312 under the insulating layer holes 331 are exposed through the blocking layer holes 321, and the transparent electrodes 345 over the insulating layer holes 331 are partially exposed by the insulating layer holes 331.

Figure 22:
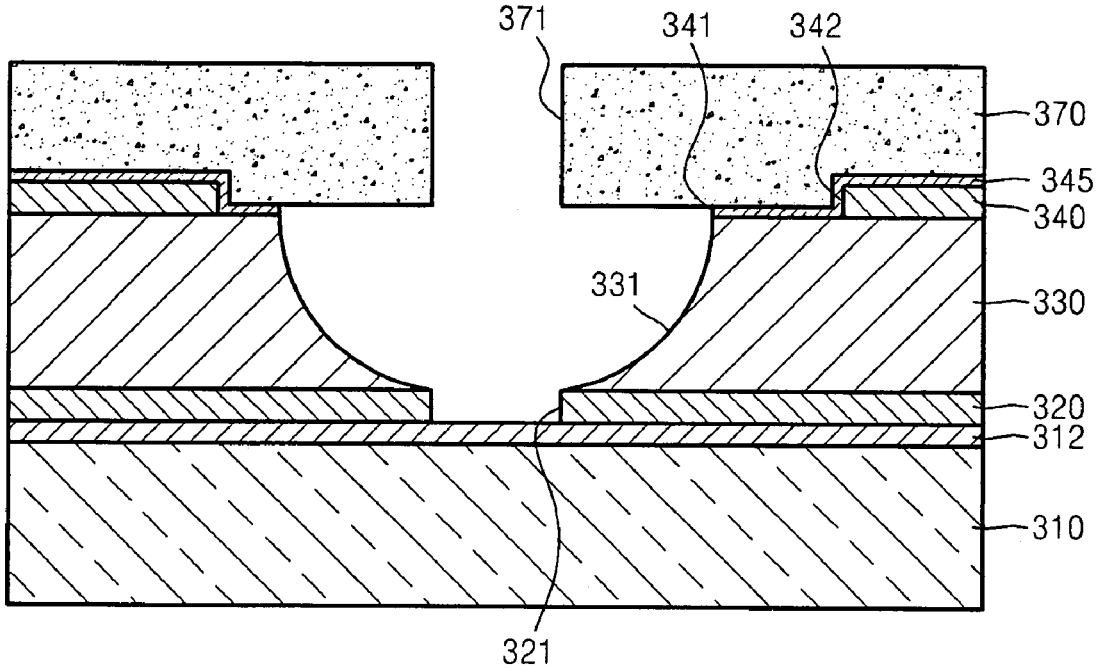

Referring to FIG. 22, portions of the transparent electrodes 345 exposed by the insulating layer holes 331 are etched to form gate holes 341. The gate holes 341 may be formed by wet etching and by removing the portions of the transparent electrodes 345 exposed by the insulating layer holes 331. Since the transparent electrodes 345 are formed of a material having etch selectivity with respect to the cathodes 312, the cathodes 312 exposed through the blocking layer holes 321 are not removed during the etching of the transparent electrodes 345. Next, the second photoresist 370 is removed from the transparent electrodes 345

Figure 23:
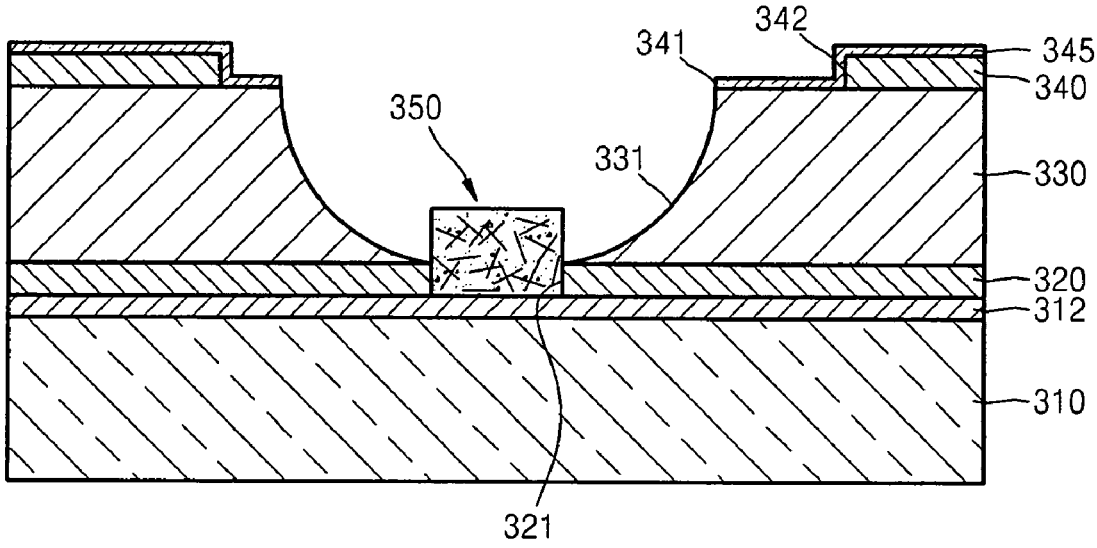

Referring to FIG. 23, emitters 350 are formed on the cathodes 312 exposed through the blocking layer holes 321. In detail, CNT paste is coated on the transparent electrodes 345 so as to fill the blocking layer holes 321, the insulting layer holes 331 and the gate holes 341. Next, when the CNT paste is exposed and developed by backside exposure using the light blocking layer 320 as a photomask, the emitters 350 formed of CNTs are formed on the cathodes 312 in the blocking layer holes 321.

As described above, since the insulating layer holes 331 are formed by isotropically etching the insulating layer 330 through the transparent electrode holes 347 which are concentric with the blocking layer holes 321, and the portions of the transparent electrodes 345 exposed by the insulating layer holes 331 are etched and removed, the gate holes 341 are precisely concentric with the blocking layer holes 321. Accordingly, the emitters 350 formed in the blocking layer holes 321 can be precisely centered in the gate holes 341.

Figure 24:
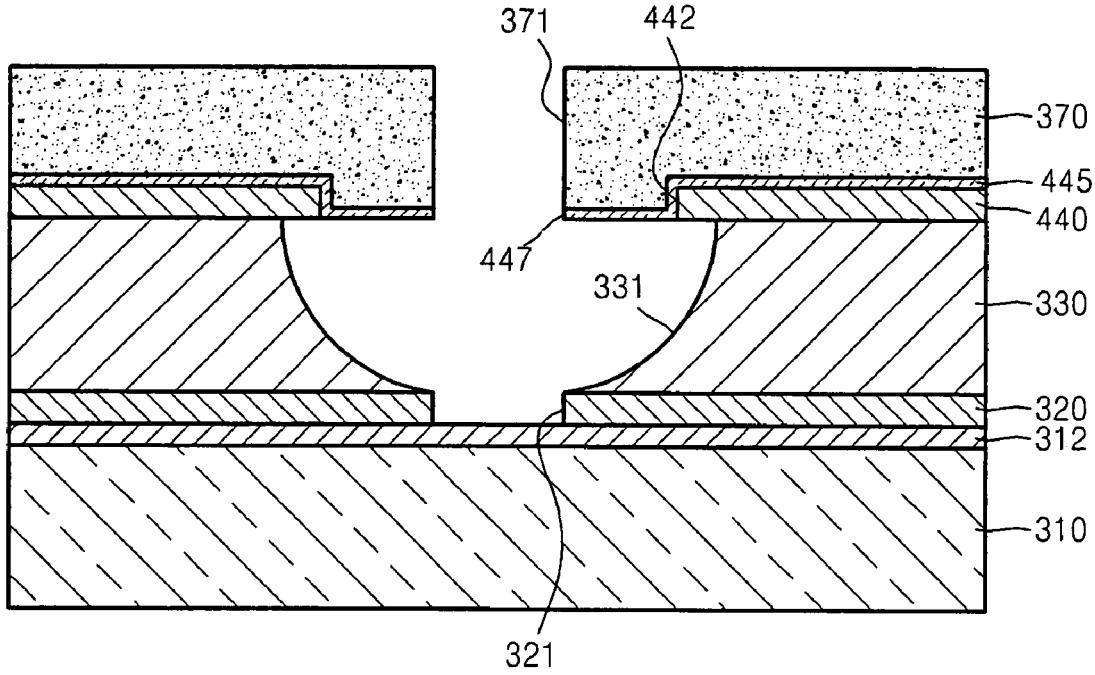
FIGS. 24 thru 26 are cross-sectional views illustrating a modification of the method of manufacturing the field emission device of FIGS. 17 thru 23.
Figure 25:
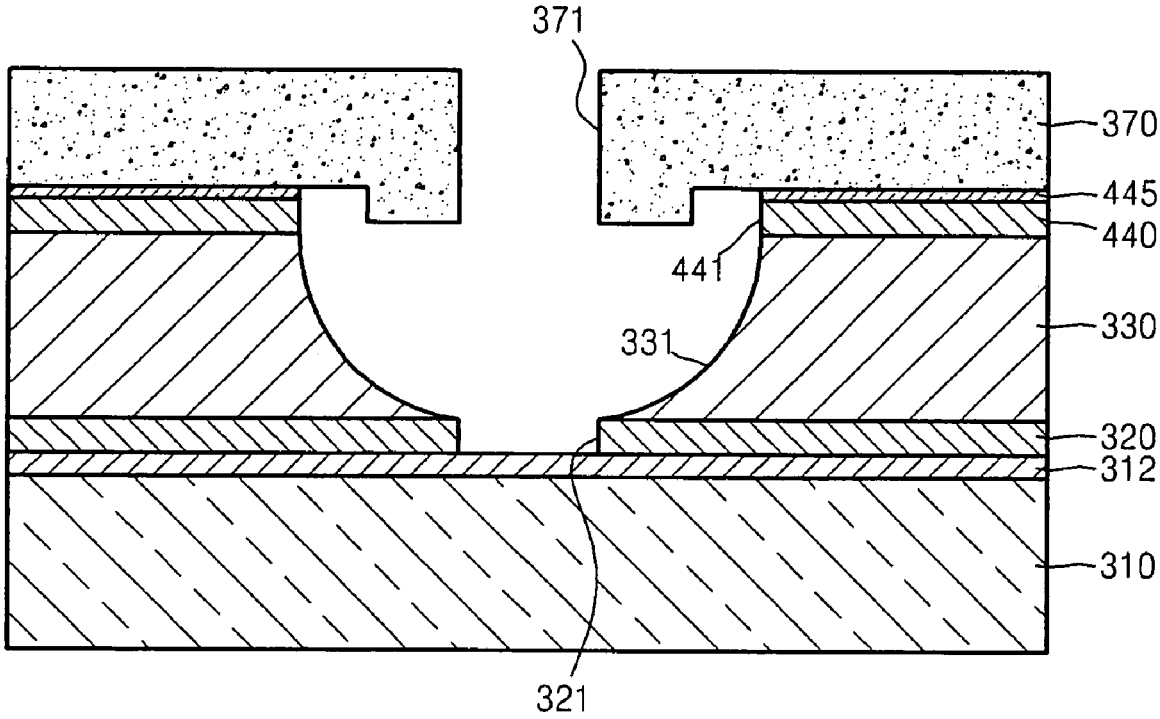
Figure 26:
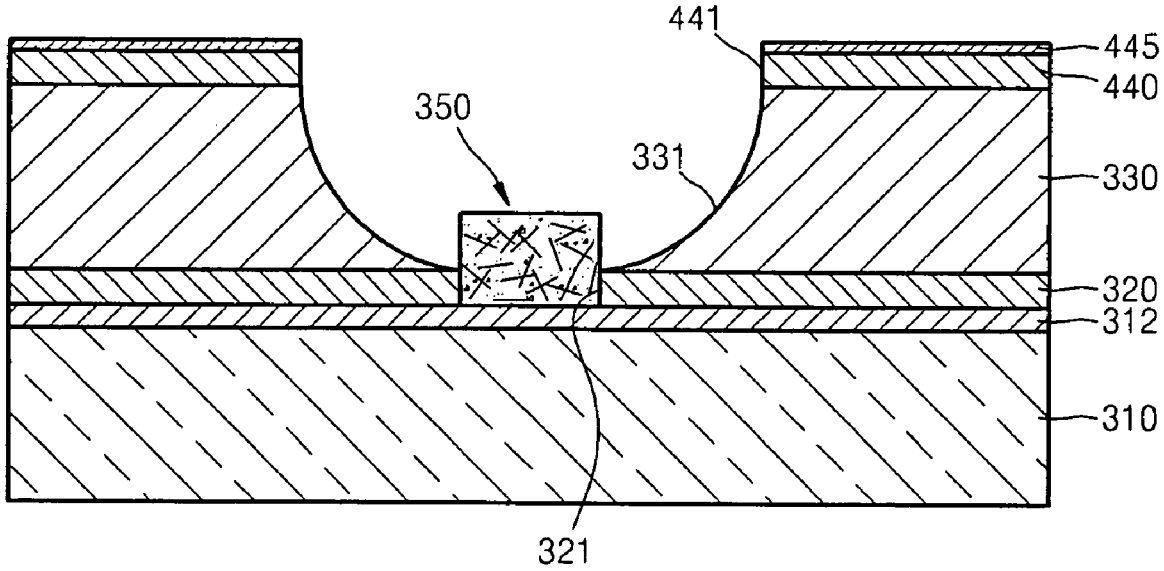

While the gate electrode holes 342 formed in the gate electrodes 340 are wider than the gate holes 341 in FIGS. 17 thru 23, gate electrode holes 442 may be wider than the blocking layer holes 321 and narrower than gate holes 441 as shown in FIGS. 24 thru 26, which are cross-sectional views illustrating a modification of the method of manufacturing the field emission device of FIGS. 17 thru 23.

Referring to FIG. 24, the gate electrode holes 442, which are wider than the blocking layer holes 321 and narrower than the gate holes 441 (see FIG. 25), are formed in gate electrodes 440. In this case, the gate electrodes 440 may be formed of a material having etch selectivity with respect to cathodes 412. Like transparent electrodes 445, the gate electrodes 440 may be formed of a metal such as Cr, Ag, Al, Mo, Nb, or Au. Accordingly, when the insulating layer holes 331 are formed by etching the insulating layer 330 through transparent electrode holes 447, the cathodes 312 under the insulating layer holes 331 are exposed through the blocking layer holes 321, and the gate electrodes 440 and the transparent electrodes 445 over the insulating layer holes 331 are partially exposed by the insulating layer holes 331.

Referring to FIG. 25, the portions of the transparent electrodes 445 and the gate electrodes 440 exposed by the insulating layer holes 331 are etched to form gate holes 441 in the gate electrodes 440 and the transparent electrodes 445. The gate holes 441 may be formed by wet etching and removing the portions of the transparent electrodes 445 and the gate electrodes 440 exposed by the insulating layer holes 331. Since the cathodes 312 are formed of a material having etch selectivity with respect to the gate electrodes 440 and the transparent electrodes 445, the cathodes 321 exposed through the blocking layer holes 321 are not removed during the etching of the gate electrodes 440 and the transparent electrodes 445. Next, the second photoresist 370 is removed from the transparent electrodes 445.

Referring to FIG. 26, the emitters 350 are formed on the cathodes 312 exposed through the blocking layer holes 321.

A method of manufacturing a field emission device according to another embodiment of the present invention will now be explained.

FIGS. 27 thru 32 are cross-sectional views illustrating a method of manufacturing a field emission device according to another embodiment of the present invention. The following explanation will be made focusing on the difference between the methods of FIGS. 3 thru 26 and the method of FIGS. 27 thru 32.

Figure 27:
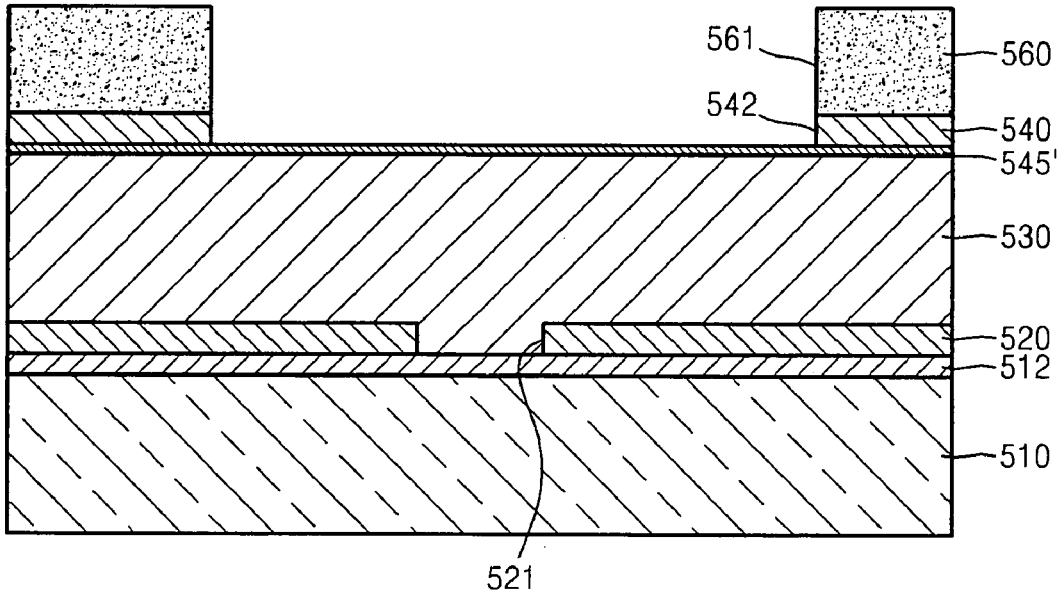
FIGS. 27 thru 32 are cross-sectional views illustrating a method of manufacturing a field emission device according to another embodiment of the present invention.

Referring to FIG. 27, cathodes 512 are formed on the substrate 510. The substrate 510 may be a transparent substrate, and the cathodes 512 may be formed of a transparent conductive material such as ITO. A light blocking layer 520 is formed on the substrate 510 so as to cover the cathodes 512, and is then patterned to form blocking layer holes 521 exposing the cathodes 512. Next, an insulating layer 530, a conductive transparent material layer 545', and a gate material layer (not shown) are formed on the light blocking layer 520. The conductive transparent material layer 545' may be formed of a metallic film having etch selectivity with respect to the cathodes 512 and the gate material layer. In this case, the metallic film may have a thickness of 100 to 500 Å. For example, the transparent material layer 545' may be formed of a metal such as Cr, Ag, Al, Mo, Nb, or Au.

Next, the gate material layer is patterned to form gate electrodes 540 in which gate electrode holes 542 exposing the transparent material layer 545' are formed. In detail, a first photoresist 560 is coated on the gate material layer. The first photoresist 560 may be a positive or negative photoresist. Next, the first photoresist 560 is exposed and developed to form first resist holes 561 exposing the gate material layer. The gate material layer is etched through the first resist holes 561 to form gate electrodes 540 in which gate electrode holes 542 exposing the transparent material layer 545' are formed. Since the transparent material layer 545' is formed of a material having etch selectivity with respect to the gate material layer, the transparent material layer 545' is not etched in this process. The gate electrode holes 542 are formed over the blocking layer holes 521. Next, the first photoresist 560 is removed from the gate electrodes 540.

Figure 28:
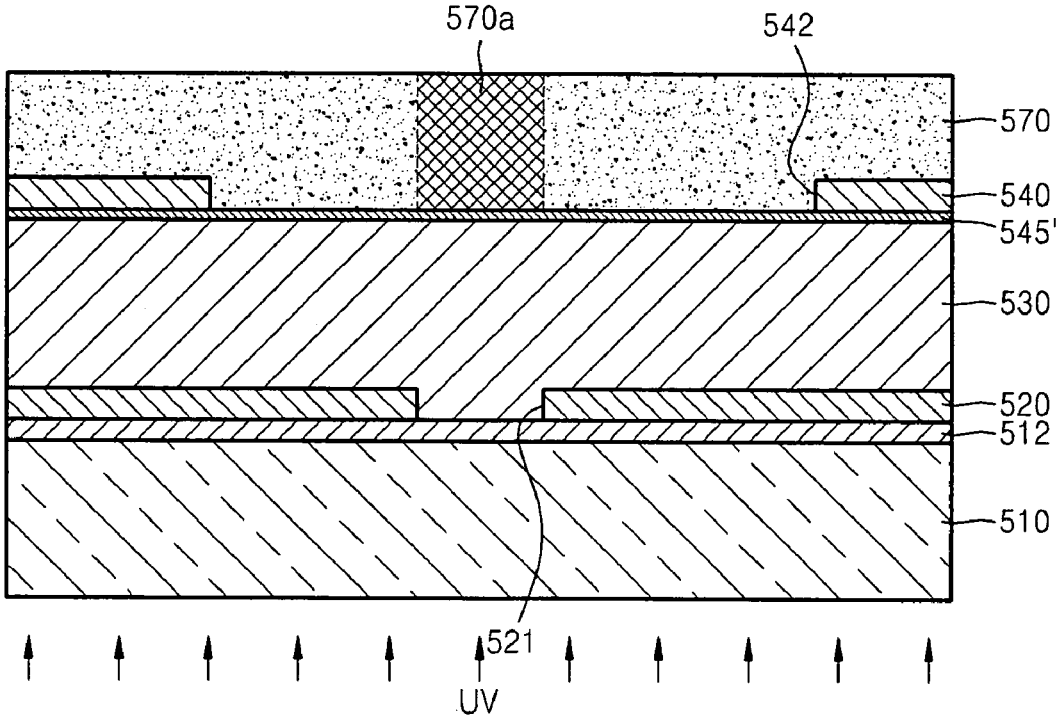

Referring to FIG. 28, a second photoresist 570 is coated to cover the gate electrodes 540 and the transparent material layer 545'. The second photoresist 570 may be a positive photoresist. Next, the second photoresist 570 is exposed by backside exposure. In detail, UV rays are emitted from below the substrate 510 using the light blocking layer 520 as a photomask so as to expose portions **570*a* of the second photoresist 570 disposed over the blocking layer holes 521**.

Figure 29:
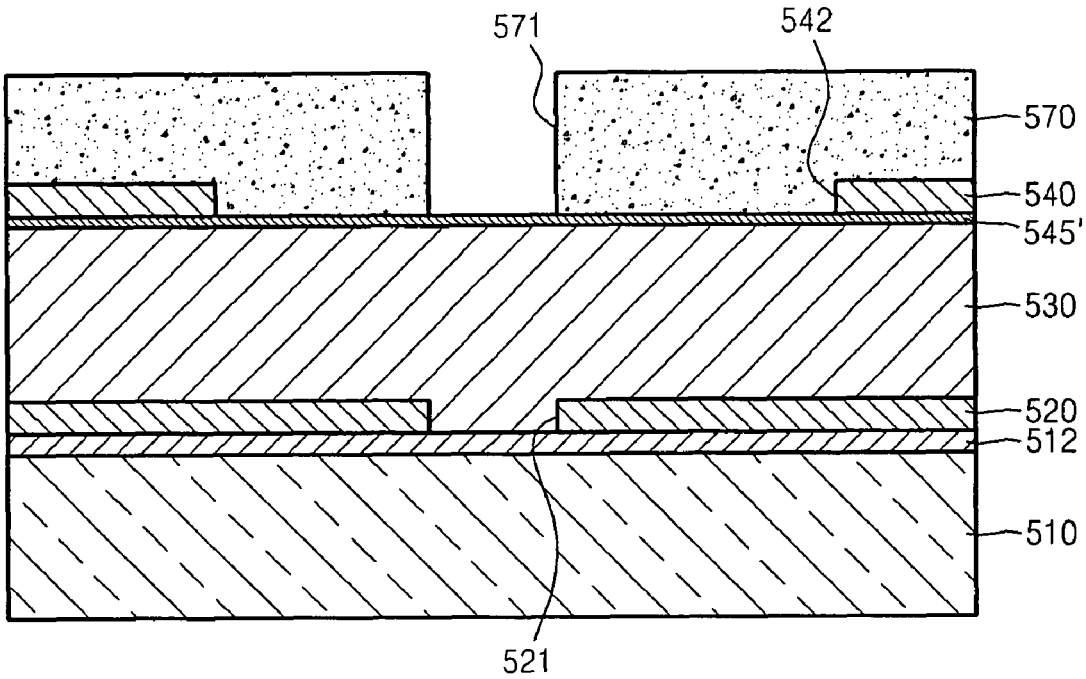

Referring to FIG. 28 and FIG. 29, when the exposed portions **570*a* of the second photoresist 570 are developed and removed, second resist holes 571 exposing the transparent material layer 545' are formed in the gate electrode holes 542. Accordingly, the second resist holes 571 are concentric with the blocking layer holes 521, and correspond in diameter and shape to the blocking layer holes 521**.

Figure 30:
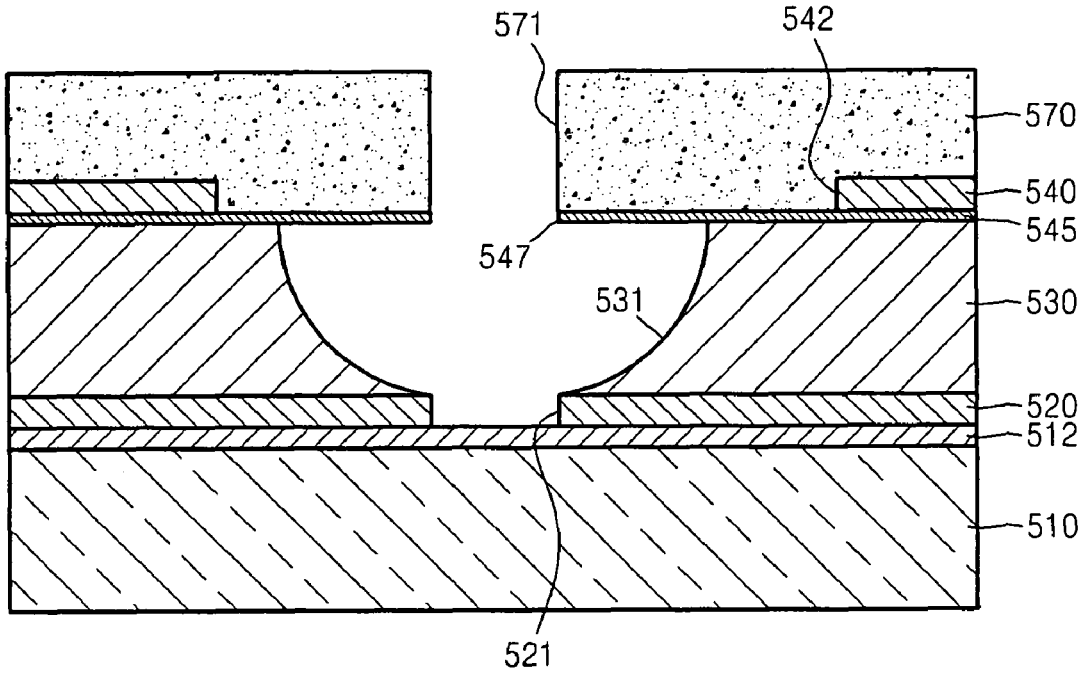

Referring to FIG. 29 and FIG. 30, portions of the transparent material layer 545' exposed through the second resist holes 571 are etched to form transparent electrodes 545 in which transparent electrode holes 547 exposing the insulating layer 530 are formed. The transparent electrodes 545 formed of a metallic film act as bus electrodes of the gate electrodes 540. Like the second resist holes 571, the transparent electrode holes 547 are concentric with the blocking layer holes 521, and correspond in diameter and shape to the blocking layer holes 521. Next, portions of the insulating layer 530 exposed through the transparent electrode holes 547 are etched to form insulating layer holes 531. The insulating layer holes 531 may be formed by isotropically wet etching the portions of the insulating layer 530 until the blocking layer holes 521 are exposed. Due to the isotropic etching of the insulating layer 530, each of the insulating layer holes 531 may have a substantially hemispheric shape. Accordingly, the cathodes 512 under the insulating layer holes 531 are exposed through the blocking layer holes 521, and the transparent electrodes 545 over the insulating layer holes 531 are partially exposed by the insulating layer holes 531.

Figure 31:
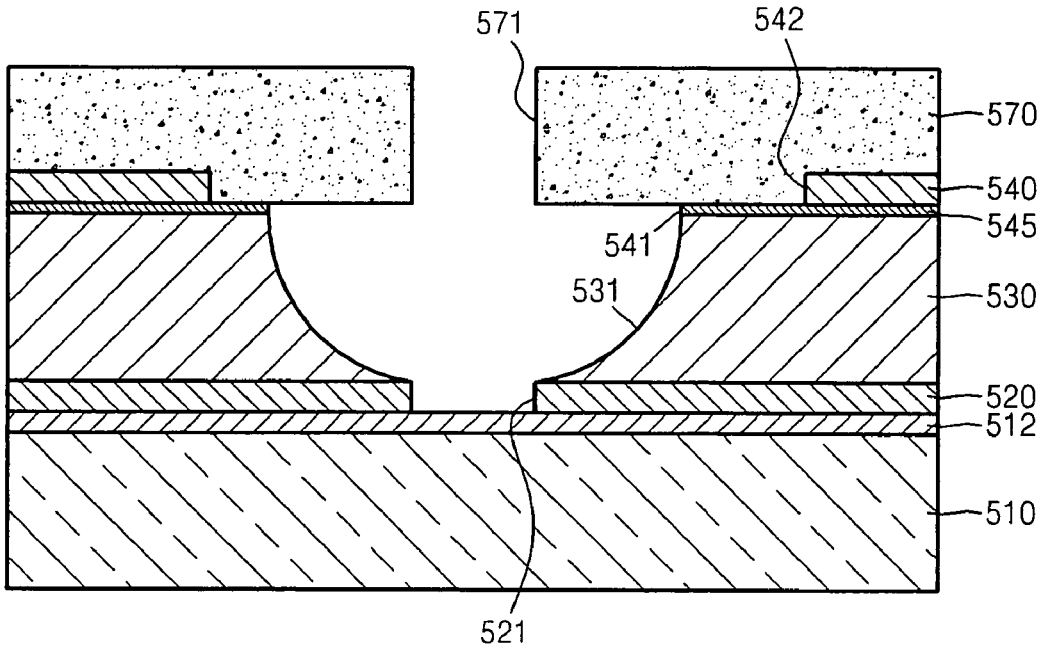

Referring to FIG. 31, the portions of the transparent electrodes 545 exposed by the insulating layer holes 531 are etched to form gate holes 541. The gate holes 541 may be formed by wet etching the portions of the transparent electrodes 545 exposed by the insulating layer holes 531. Since the transparent electrodes 545 are formed of a material having etch selectivity with respect to the cathodes 512, the cathodes 512 exposed through the blocking layer holes 521 are not removed during the etching of the transparent electrodes 545. Next, the second photoresist 570 is removed from the transparent electrodes 545 and the gate electrodes 540.

Figure 32:
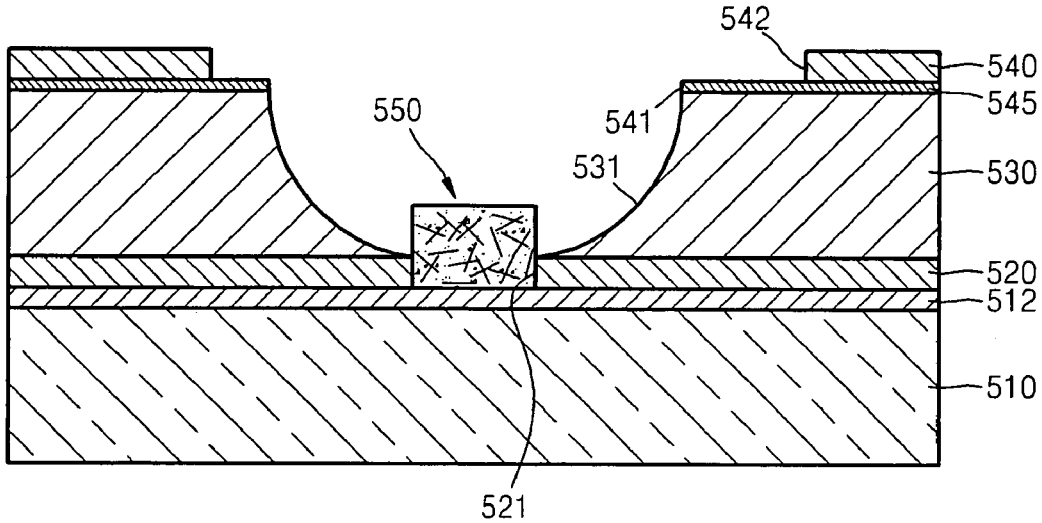

Referring to FIG. 32, emitters 550 are formed on the cathodes 512 exposed through the blocking layer holes 521. In detail, CNT paste is coated on the transparent electrodes 545 and the gate electrodes 540 to fill the blocking layer holes 521, the insulating layer holes 531 and the gate holes 541. Next, when the CNT paste is exposed and developed by backside exposure using the light blocking layer 520 as a photomask, the emitters 550 formed of CNTs are formed on the cathodes 512 in the blocking layer holes 521.

As described above, since the insulating layer holes 531 are formed by isotropically etching the insulating layer 530 through the transparent electrode holes 547 which are concentric with the blocking layer holes 521, and the portions of the transparent electrodes 545 exposed by the insulating layer holes 531 are etched and removed, the gate holes 541 are precisely concentric with the blocking layer holes 521. Accordingly, the emitters 550 formed in the blocking layer holes 521 can be precisely centered in the gate holes 541. While the gate electrode holes 542 are wider than the gate holes 541 in FIGS. 27 thru 32, the gate electrode holes 542 may be wider than the blocking layer holes 521 and narrower than the gate holes 541.

As described above, according to the present invention, gate holes can be precisely concentric with blocking layer holes. Therefore, emitters formed in the blocking layer holes can be precisely centered in the gate holes, thereby improving electron emission uniformity and making it possible to realize a stable and reliable field emission device.

While the present invention has been particularly shown and described with reference to exemplary embodiments thereof, it will be understood by those of ordinary skill in the art that various changes in form and detail may be made therein without departing from the spirit and scope of the present invention as defined by the following claims.

What is claimed is:

1. A method of manufacturing a field emission device, the method comprising the steps of:

sequentially forming cathodes and a light blocking layer on a substrate, and patterning the light blocking layer to form blocking layer holes exposing the cathodes;

sequentially forming an insulating layer and a gate material layer on the light blocking layer, and patterning the gate material layer to form gate electrodes in which gate electrode holes exposing portions of the insulating layer disposed over the blocking layer holes are formed;

forming a conductive transparent material layer on top surfaces of the gate electrodes and portions of the insulating layer exposed by the gate electrode holes;

coating a photoresist on the transparent material layer, and exposing and developing the photoresist so as to form resist holes that are substantially the same in diameter and shape to the blocking layer holes, and to expose portions of the transparent material layer disposed over the blocking layer holes;

etching the portions of the transparent material layer exposed by the resist holes to form transparent electrodes in which transparent electrode holes exposing portions of the insulating layer are formed;

isotropically etching the portions of the insulating layer exposed through the transparent electrode holes until the blocking layer holes are exposed to form insulating layer holes;

etching the transparent electrodes exposed by the insulating layer holes to form gate holes, and removing the photoresist; and forming emitters on the cathodes exposed by the blocking layer holes, wherein the conductive transparent material layer is formed of a metallic film having etch selectivity with respect to the cathodes, and wherein the resist holes are formed by exposing and developing the photoresist with a backside exposure using the light blocking layer as a photomask.

2. The method of claim 1, wherein the conductive transparent material layer is formed of a metal selected from the group consisting of Cr, Ag, Al, Mo, Nb, and Au.

3. The method of claim 1, wherein the conductive transparent material layer has a thickness in a range of 100 Å to 500 Å.

4. The method of claim 1, wherein the photoresist is a positive photoresist.

5. The method of claim 1, wherein the resist holes and the transparent electrode holes are concentric with the blocking layer holes.

6. The method of claim 1, wherein the substrate is a transparent substrate.

7. The method of claim 1, wherein the light blocking layer is formed of amorphous silicon.

8. The method of claim 1, wherein the cathodes are formed of a transparent conductive material.

9. The method of claim 8, wherein the cathodes are formed of indium tin oxide (ITO).

10. The method of claim 1, wherein the insulating layer is formed of a transparent material.

11. The method of claim 1, wherein the gate electrode holes are wider than the gate holes.

12. The method of claim 11, wherein the gate material layer is formed of one of Cr, Ag, Al, Mo, Nb, Au, and ITO.

13. The method of claim 1, wherein the gate electrode holes are wider than the blocking layer holes and narrower than the gate holes.

14. The method of claim 13, wherein the gate material layer is formed of a material having etch selectivity with respect to the cathodes.

15. The method of claim 14, wherein the gate holes are formed by etching the gate electrodes and the transparent electrodes exposed by the insulating layer holes.

16. The method of claim 1, wherein the insulating layer is wet etched.

17. The method of claim 1, wherein the forming of the emitters comprises:

coating CNT paste to fill the blocking layer holes, the insulating layer holes, and the gate holes; and exposing and developing the CNT paste through backside exposure using the light blocking layer as a photomask, and forming emitters formed of CNTs on the cathodes exposed by the blocking layer holes.

18. A method of manufacturing a field emission device, the method comprising the steps of:

sequentially forming cathodes and a light blocking layer on a substrate, and patterning the light blocking layer to form blocking layer holes exposing the cathodes;

forming an insulating layer on the light blocking layer, forming a conductive transparent material layer on a top surface of the insulating layer, forming a gate material layer on a top surface of the conductive transparent material layer, and patterning the gate material layer to form gate electrodes in which gate electrode holes exposing portions of the transparent material layer disposed over the blocking layer holes are formed;

coating a photoresist to cover the gate electrodes and the portions of the transparent material layer, and exposing and developing the photoresist so as to form resist holes that are substantially the same in diameter and shape to the blocking layer holes, and to expose portions of the transparent material layer disposed over the blocking layer holes;

etching the portions of the transparent material layer exposed by the resist holes to form transparent electrodes in which transparent electrode holes exposing portions of the insulating layer are formed;

isotropically etching the portions of the insulating layer exposed through the transparent electrode holes until the blocking layer holes are exposed to form insulating layer holes;

etching portions of the transparent electrodes exposed by the insulating layer holes to form gate holes, and removing the photoresist; and forming emitters on the cathodes exposed by the blocking layer holes, wherein the conductive transparent material layer is formed of a metallic film having etch selectivity with respect to the cathodes and the gate material layer, wherein the resist holes are formed by exposing and developing the photoresist with a backside exposure using the light blocking layer as a photomask.

19. The method of claim 18, wherein the conductive transparent material layer is formed of a metal selected from the group consisting of Cr, Ag, Al, Mo, Nb, and Au.

20. The method of claim 18, wherein the conductive transparent material layer has a thickness in a range of 100 Å to 500 Å.

21. The method of claim 18, wherein the photoresist is a positive photoresist.

22. The method of claim 18, wherein the resist holes and the transparent electrode holes are concentric with the blocking layer holes.

23. The method of claim 18, wherein the substrate is a transparent substrate.

24. The method of claim 18, wherein the light blocking layer is formed of amorphous silicon.

25. The method of claim 18, wherein the cathodes are formed of a transparent conductive material.

26. The method of claim 25, wherein the cathodes are formed of indium tin oxide (ITO).

27. The method of claim 18, wherein the insulating layer is formed of a transparent material.

28. The method of claim 18, wherein the insulating layer is wet etched.

29. The method of claim 18, wherein the forming of the emitters comprises:

coating CNT paste to fill the blocking layer holes, the insulating layer holes, and the gate holes; and exposing and developing the CNT paste through backside exposure using the light blocking layer as a photomask, and forming emitters formed of CNTs on the cathodes exposed by the blocking layer holes.

* * * * *